US012180687B2

(12) United States Patent
Jakubisin et al.

(10) Patent No.: US 12,180,687 B2
(45) Date of Patent: Dec. 31, 2024

(54) BUCKET LIP STABILIZER STRUCTURE

(71) Applicant: Hensley Industries, Inc., Dallas, TX (US)

(72) Inventors: John Scott Jakubisin, Fort Worth, TX (US); Keith Daniel Aug, Fate, TX (US); Mohamad Youssef Bilal, Little Elm, TX (US)

(73) Assignee: Hensley Industries, Inc., Dallas, TX (US)

( * ) Notice: Subject to any disclaimer, the term of this patent is extended or adjusted under 35 U.S.C. 154(b) by 580 days.

(21) Appl. No.: 17/373,439

(22) Filed: Jul. 12, 2021

(65) Prior Publication Data

US 2021/0340737 A1 Nov. 4, 2021

Related U.S. Application Data

(63) Continuation of application No. 16/052,741, filed on Aug. 2, 2018, now Pat. No. 11,066,812.

(60) Provisional application No. 62/542,079, filed on Aug. 7, 2017.

(51) Int. Cl.
*E02F 9/28* (2006.01)

(52) U.S. Cl.
CPC ..... *E02F 9/2825* (2013.01); *E02F 9/2833* (2013.01); *E02F 9/2858* (2013.01)

(58) Field of Classification Search
CPC ..... E02F 9/2825; E02F 9/2833; E02F 9/2858
See application file for complete search history.

(56) References Cited

U.S. PATENT DOCUMENTS 1,003,663 A * 9/1911 Skelton ..... E02F 9/2825 37/454
3,462,861 A 8/1969 Kampert
5,016,365 A 5/1991 Robinson
5,412,885 A 5/1995 Cornelius
5,465,512 A 11/1995 Livesay et al.
5,533,408 A 9/1996 Irving
(Continued)

FOREIGN PATENT DOCUMENTS

EP 2584105 A2 4/2013
UA 115536 C2 11/2017
(Continued)

OTHER PUBLICATIONS

International Search Report and Written Opinion, PCT/US2018/045178 dated Oct. 22, 2018, 10 pages.

*Primary Examiner* — Jessica H Lutz
(74) *Attorney, Agent, or Firm* — Haynes and Boone, LLP

(57) ABSTRACT

A stabilizer structure includes an elongated main body portion having an upper portion with outward-facing side surfaces and a lower portion below the upper portion, the lower portion being greater in width than the upper portion. The stabilizer structure also includes a hole in a top surface of the upper portion. The stabilizer also includes a forward portion integrated with the main body portion as a single monolithic piece. The forward portion includes a bridge section, a first prong extending from the bridge section, and a second prong extending from the bridge section. The first prong, second prong, and bridge section share a single forward-facing curved surface and a single rear-facing curved surface, the forward-facing curved surface having a different curve than the rear-facing curved surface.

20 Claims, 21 Drawing Sheets

(56) References Cited

U.S. PATENT DOCUMENTS

| | | | | |
|---|---|---|---|---|
| 5,553,409 | A * | 9/1996 | Irving | A01B 15/02 37/446 |
| 5,653,048 | A | 8/1997 | Jones | |
| 5,713,145 | A | 2/1998 | Ruvang | |
| 5,806,216 | A | 9/1998 | Renski | |
| 6,151,812 | A | 11/2000 | Bierwith | |
| 6,209,238 | B1 | 4/2001 | Ruvang | |
| 6,301,810 | B1 | 10/2001 | Fidler | |
| 6,729,052 | B2 | 5/2004 | Ollinger, IV et al. | |
| 6,986,216 | B2 | 1/2006 | Emrich et al. | |
| 7,036,249 | B2 | 5/2006 | Mautino | |
| 7,165,347 | B2 | 1/2007 | Ollinger, IV et al. | |
| 7,299,570 | B2 | 11/2007 | Emrich et al. | |
| 7,451,558 | B2 | 11/2008 | Jones | |
| 7,596,895 | B2 | 10/2009 | Jones | |
| 7,690,136 | B2 | 4/2010 | Breken | |
| 7,730,652 | B2 | 6/2010 | McClanahan et al. | |
| 7,793,444 | B2 | 9/2010 | Jones | |
| 7,980,011 | B2 | 7/2011 | Ruvang | |
| RE42,629 | E | 8/2011 | Jones et al. | |
| 8,261,472 | B2 | 9/2012 | Ruvang | |
| 8,302,333 | B2 | 11/2012 | Ruvang | |
| 8,307,574 | B2 | 11/2012 | Ruvang | |
| 8,429,838 | B2 | 4/2013 | Ruvang | |
| 8,561,326 | B2 | 10/2013 | Ruvang | |
| 8,819,967 | B2 | 9/2014 | Campomanes | |
| 8,925,220 | B2 * | 1/2015 | Stangeland | E02F 9/2825 37/452 |
| 8,943,718 | B2 | 2/2015 | Ruvang | |
| 9,222,243 | B2 | 12/2015 | Chyne et al. | |
| 9,290,915 | B2 | 3/2016 | Marchand | |
| 9,409,258 | B2 | 8/2016 | Ruvang | |
| 9,453,328 | B2 | 9/2016 | Strangeland et al. | |
| 9,903,101 | B2 | 2/2018 | Serrurier | |
| 9,988,795 | B2 * | 6/2018 | Hooijmans | E02F 9/2808 |
| 10,053,839 | B2 * | 8/2018 | Serrurier | E02F 9/2858 |
| D832,309 | S * | 10/2018 | Balan | D15/28 |
| 10,119,252 | B2 | 11/2018 | Campomanes | |
| 10,273,663 | B2 | 4/2019 | Kunz | |
| 10,519,632 | B2 * | 12/2019 | Campomanes | E02F 9/2883 |
| 11,396,739 | B2 | 7/2022 | Popp | |
| 2005/0039289 | A1 | 2/2005 | Buxton | |
| 2008/0005940 | A1 | 1/2008 | Ollinger | |
| 2011/0256272 | A1 | 10/2011 | Briscoe | |
| 2013/0212916 | A1 | 8/2013 | Stangeland et al. | |
| 2013/0247427 | A1 | 9/2013 | Campomanes | |
| 2014/0202050 | A1 | 7/2014 | Briscoe et al. | |
| 2016/0237658 | A1 | 8/2016 | Ruvang | |
| 2016/0356023 | A1 | 12/2016 | Ruvang | |
| 2016/0362873 | A1 | 12/2016 | Campomanes | |
| 2017/0328036 | A1 | 11/2017 | Bilal et al. | |

FOREIGN PATENT DOCUMENTS

| | | | |
|---|---|---|---|
| WO | 2012012642 | A1 | 2/2002 |
| WO | 2015092473 | A1 | 6/2015 |

* cited by examiner

BUCKET LIP STABILIZER STRUCTURE

PRIORITY DATA

This application is a continuation application of U.S. patent application Ser. No. 16/052,741 filed on Aug. 2, 2018; which claims the benefit of U.S. Provisional Patent Application No. 62/542,079 filed Aug. 7, 2017, each of which are herein incorporated by reference in its entirety.

TECHNICAL FIELD

This disclosure is generally directed to a stabilizer structure for use in securing a wear member such as an adapter and/or other wear member to a bucket lip. More particularly, this disclosure is directed to a stabilizer structure that is able to be secured to a bucket lip and provide stabilization to an adapter.

BACKGROUND

Material displacement apparatuses, such as excavating buckets found on construction, mining, and other earth moving equipment, often include replaceable wear members such as earth engaging teeth. These are often removably attached to larger base structures, such as adapters, and come into abrasive, wearing contact with the earth or other material being displaced. For example, excavating tooth assemblies provided on digging equipment, such as excavating buckets and the like, typically comprise a relatively massive adapter which is suitably anchored to the forward bucket lip. The adapter typically includes a forwardly projecting nose. A replaceable earth engaging tooth typically includes a rear-facing cavity that releasably receives the adapter nose. To retain the earth engaging tooth on the adapter nose, generally aligned transverse openings may be formed on both the earth engaging tooth and the adapter nose, and a suitable connector structure is driven into and forcibly retained within the aligned openings to releasably anchor the replaceable earth engaging tooth on its associated adapter nose.

During normal operations, the earth engaging tooth experiences high loading in multiple directions. These loads are transferred from the tooth to the adapter. As earth moving equipment technology advances, earthmovers are used to accomplish more in shorter amounts of time, ever-increasing loading and wear on ground engaging teeth, adapters, and buckets. In order to maintain the adapter in place on the bucket lip when subjected to high loading, additional stabilization may be desirable. A need accordingly exists for an improved stabilizer for stabilizing the adapter in place on the bucket lip.

BRIEF DESCRIPTION OF THE DRAWINGS

The accompanying drawings illustrate implementations of the systems, devices, and methods disclosed herein and together with the description, serve to explain the principles of the present disclosure.

Figure 1:
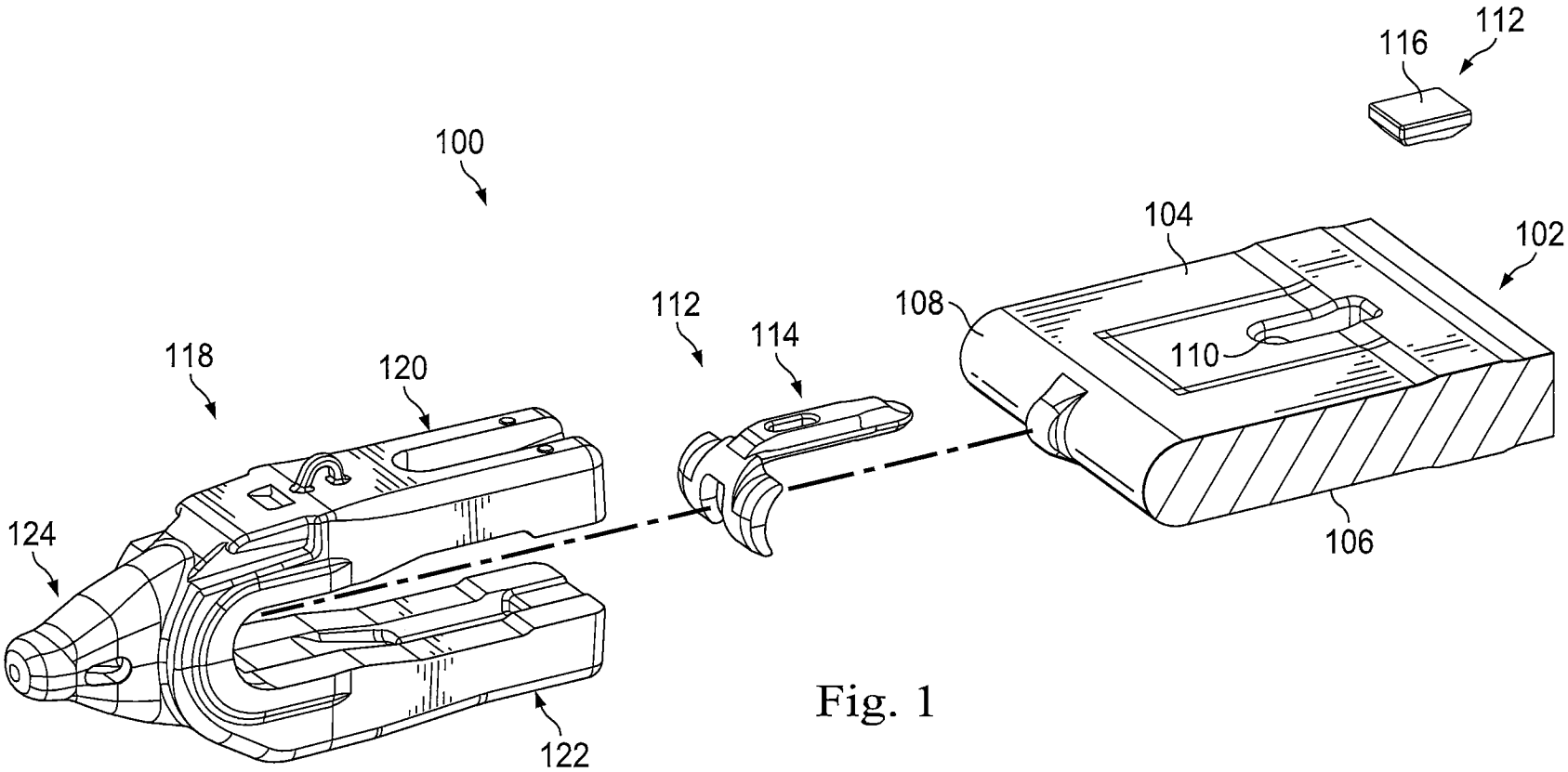
FIG. 1 is a diagram showing an exploded view of a wear member assembly including a stabilizer structure for securing an adapter to a bucket lip according to an example incorporating principles described herein.

These Figures will be better understood by reference to the following detailed description.

DETAILED DESCRIPTION

For the purposes of promoting an understanding of the principles of the present disclosure, reference will now be made to the implementations illustrated in the drawings and specific language will be used to describe them. It will nevertheless be understood that no limitation of the scope of the disclosure is intended. Any alterations and further modifications to the described devices, instruments, methods, and any further application of the principles of the present disclosure are fully contemplated as would normally occur to one skilled in the art to which the disclosure relates. In addition, this disclosure describes some elements or features in detail with respect to one or more implementations or Figures, when those same elements or features appear in subsequent Figures, without such a high level of detail. It is fully contemplated that the features, components, and/or steps described with respect to one or more implementations or Figures may be combined with the features, components, and/or steps described with respect to other implementations or Figures of the present disclosure. For simplicity, in some instances the same or similar reference numbers are used throughout the drawings to refer to the same or like parts.

The present disclosure is directed to a stabilizer structure for use in a wear member assembly. According to one example, the wear member assembly includes a bucket lip. The bucket lip includes a first surface (e.g., a top surface) and a second surface (e.g., a bottom surface) that faces opposite the first surface and extends substantially parallel to the first surface. The bucket lip may also include a curved, forward-facing surface that extends between the top surface and the bottom surface. The bucket lip may also include an anchor hole extending through the bucket lip between the top surface and the bottom surface. The stabilizer structure may include one component or two separate components; particularly, a forward stabilizer portion and a rear stabilizer portion. The forward stabilizer portion may be arranged to fit along the top surface between the anchor hole and the curved surface. The forward stabilizer portion may be sized and shaped to extend over and conform to the curved surface. In some implementations, the rear stabilizer portion may be positioned rearward of the anchor hole. The wear member assembly may also include an adapter that has a pair of bifurcated legs. The bifurcated legs may be adapted to fit over the bucket lip such that the first leg fits along the first surface and the second leg fits along the second surface. The first leg may include a slot arranged to receive both the forward stabilizer portion and the rear stabilizer portion.

FIG. 1 is a diagram showing an exploded view of a wear member assembly 100 that includes a stabilizer structure 112 for securing an adapter 118 to a bucket lip 102. According to the present example, the bucket lip 102 includes a first surface 104, a second surface 106, a curved surface 108, and an anchor hole 110.

The first surface 104 in the implementation shown is the top surface 104. When the bucket lip 102 is positioned to engage the ground, the top surface 104 generally faces away from the ground. In some implementations, the top surface 104 may be substantially planar.

The second surface 106 in the implementation shown is the bottom surface 106. When the bucket lip 102 is positioned to engage the ground, the bottom surface 106 may generally face towards, and/or slide along, the ground. The bottom surface 106 may also be substantially planar. Additionally, the bottom surface 106 may also be substantially parallel to the top surface 104. In some examples, such as the one illustrated, the bottom surface 106 and the top surface 104 are completely parallel. Thus, the angle between the two surfaces 104, 106 is approximately zero degrees. In some examples, however, there may be a slight angle between the two surfaces 104, 106 such that the bucket lip 102 expands in thickness (the distance between the top surface 104 and the bottom surface 106) as the bucket lip 102 extends rearward.

The forward-facing, curved surface 108 extends between the top surface 104 and the bottom surface 106. In some aspects, the curved surface 108 may have an elliptical curve. In some examples, the curved surface 108 may have a circular curve. In the present example, the curved surface has a circular curve with a radius approximately half the distance between the top surface 104 and the bottom surface 106. The bucket lip 102 will be described in further detail below in the text accompanying FIG. 2.

The stabilizer structure 112 includes two components, although the components may function together or may be used independent of each other. In the present example, the stabilizer structure 112 includes a forward stabilizer portion 114 and a rear stabilizer portion 116. The forward stabilizer portion 114 is designed to be secured (e.g., welded) to the top surface 104 of the bucket lip 102. The forward stabilizer portion 114 also has a curved section that extends over and conforms to the curved surface 108. The forward stabilizer portion 114 will be described in further detail below in the text accompanying FIGS. 3-5B. The rear stabilizer portion 116 is also designed to be secured (e.g., welded) to the top surface 104 of the bucket lip 102. In the example shown, the rear stabilizer portion 116 is positioned rearward of the anchor hole 110.

The adapter 118 fits onto the bucket lip 102. The adapter 118 has a forward-facing nose portion 124 that is designed to receive a wear member (e.g., 900, FIG. 9) such as an intermediate adapter, a replaceable tooth or other wear member. The rear portion of the adapter 118 includes a pair of bifurcated legs 120, 122. In this embodiment, the first leg 120 fits over the stabilizer structure 112, more particularly, both stabilizer portions 114, 116 of the stabilizer structure 112. In this embodiment, the second leg 122 fits along the bottom surface 106, but does not fit over any stabilizer portions or bosses. The adapter 118 will be described in further detail below in the text accompanying FIGS. 6-7C.

Figure 2:
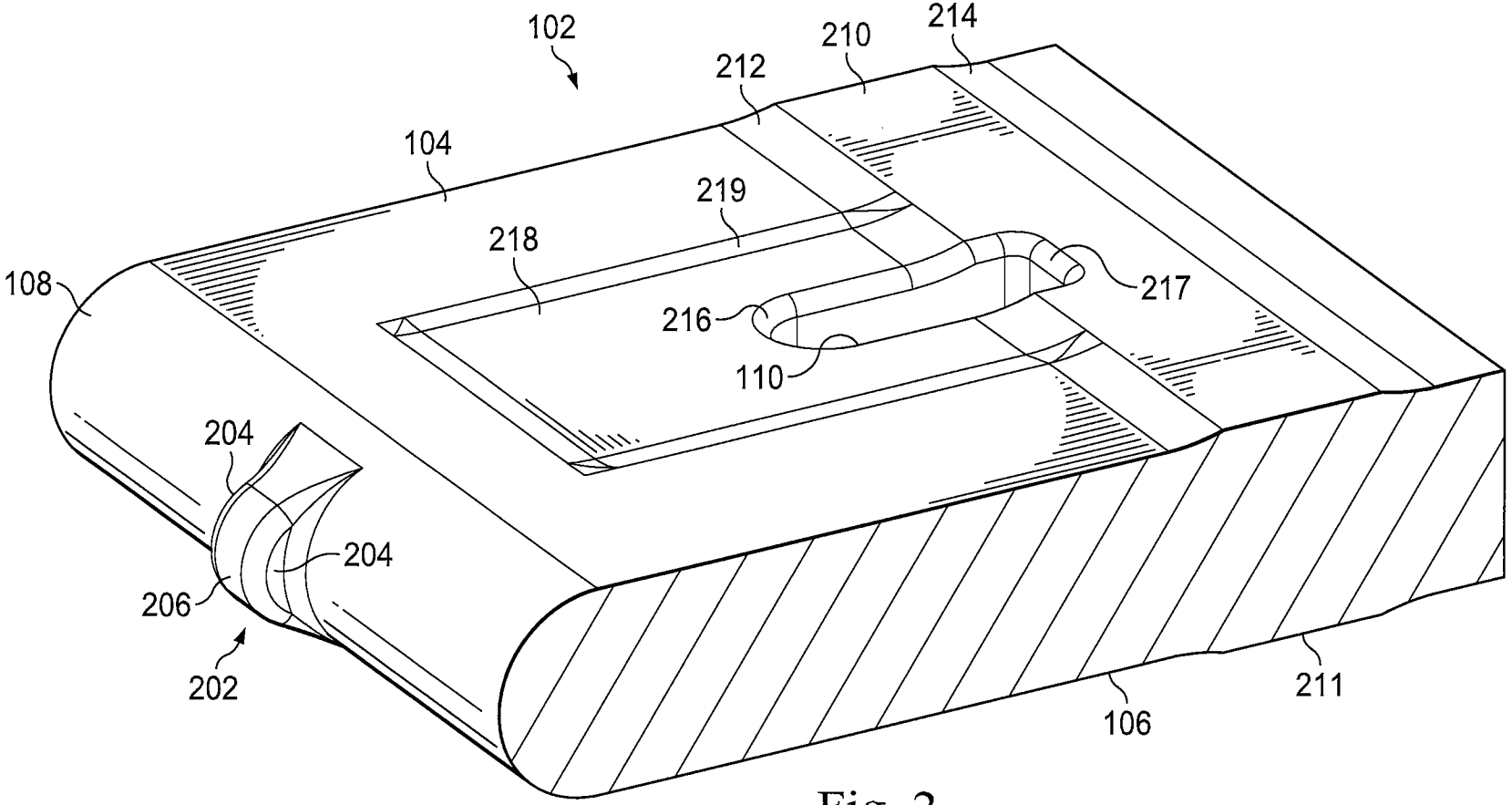
FIG. 2 is a diagram showing a perspective view of the bucket lip according to an example incorporating principles described herein.

FIG. 2 is a diagram showing a perspective view of the bucket lip 102. As mentioned above, the bucket lip 102 includes a top surface 104, a bottom surface 106, and a forward-facing, curved surface 108. The bucket lip 102 also includes a projection 202 extending from the curved surface 108, an indented portion 218, and a raised portion 210.

The projection 202 includes a forward surface 206 and two side surfaces 204. As will be explained in further detail below, the forward stabilizer portion 114 includes two prongs (e.g., 306, 308, FIG. 3) that straddle the projection 202 and fit along the side surfaces 204. The projection 202 may serve a variety of functions. For example, the projection 202 may help to appropriately position the forward stabilizer portion 114 on the bucket lip 102. The side surfaces 204 of the projection 202 may also help stabilize the forward stabilizer portion 114. Additionally, the forward surface 206 may abut against a rear-facing surface (e.g., 614, FIG. 6) of the adapter 118. In some examples, however, there may be no contact between the forward surface 206 and the adapter 118. In some examples, the bucket tip 102 may be devoid of a projection on the curved surface 108.

In the present example, the top surface 104 of the bucket lip 102 includes an indented portion 218. The indented portion 218 may be rectangular in shape. The indented portion may be aligned with the projection 202. The long dimension of the indented portion 218 may extend from the front of the bucket lip 102, represented by the curved surface 108, to a more rearward position on the bucket lip 102. The junction between the indented portion 218 and the remaining portion of the bucket lip 102 may be bridged by ramped surfaces 219. In some implementations, the bucket lip 102 may be devoid of an indented portion 218. It may also have shapes other than rectangular.

The raised portion 210 may extend parallel to the front edge, or the curved surface 108, of the bucket lip 102. The raised portion 210 may have a forward-facing ramped surface 212 and a rearward-facing ramped surface 214. In some examples, there may be a corresponding raised surface 211 on the bottom surface 106.

The anchor hole 110 is sized and shaped to allow a wedge member to fit therethrough in order to hold the adapter 118 to the bucket lip 102. One example of such a wedge member is described in U.S. Pat. No. 8,898,937, which is hereby incorporated by reference in the entirety. Other types of wedge members are contemplated. In the present example, the anchor hole 110 is placed partially within the indented portion 218 and partially on the raised portion 210. In the present example, the rear portion 217 of the anchor hole 110 has a straight edge and the forward portion 216 of the anchor hole 110 has a rounded edge. Other shapes of the anchor hole 110 are contemplated.

Figure 3:
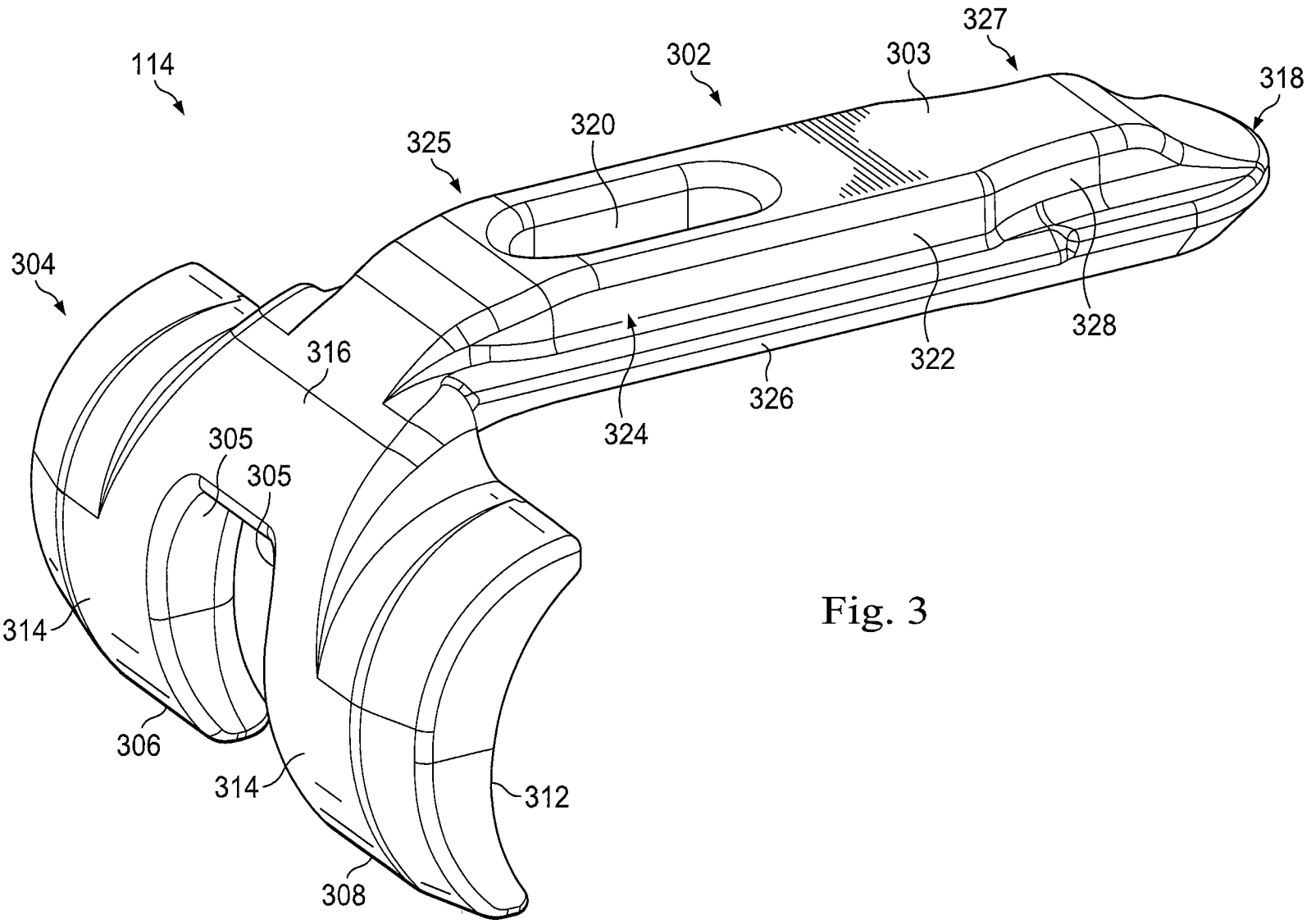
FIG. 3 is a diagram showing a perspective view of a forward stabilizer portion of a stabilizer structure according to an example incorporating principles described herein.

FIG. 3 is a diagram showing a forward stabilizer portion 114 of a stabilizer structure 112. According to the present example, the forward stabilizer portion, which in this implementation is the forward stabilizer portion 114, includes a main body portion 302 and a forward portion 304. The main body portion 302 is sized and shaped to fit along the top surface 104 of the bucket lip 102 (FIG. 2). The forward portion 304 is sized and shaped to fit along and conform to the curved surface 108 of the bucket lip 102 (FIG. 2).

The main body portion 302 includes an upper portion 324 and a lower portion 326. The lower portion 326 may be wider than the upper portion 324. The upper portion 324 includes outer surfaces 322 that, as will be explained in detail below, fit against side surfaces (e.g., 706, FIG. 7B) of a slot (e.g., 702, FIG. 7B) in an adapter leg 120. The lower portion 326 may be designed to be welded to the top surface 104 of the bucket lip 102.

The upper portion 324 of the main body portion 302 also includes a narrow rear portion 327 that is narrower in width than the more forward section 325 of the main body portion 302. Thus, the side surfaces 328 of the narrow rear portion 327 do not abut against an inner surface of a slot on the adapter leg. The rearmost portion 318 of the main body portion may be rounded, as shown in the present example. However, in some examples, the rearmost portion 318 may have other shapes, such as rectangular.

The main body portion 302 also includes a hole 320 in the top side 303 of the main body portion 302. The hole 320 may provide a number of advantages. For example, the hole 320 may allow for more weld locations. The hole 320 may also allow for less material to be used when manufacturing the stabilizer structure 112.

The forward portion 304 is integrated with the main body portion 302 as a single monolithic piece. The forward portion 304 includes a bridge section 316 and two prongs 306, 308 that extend from the bridge section 316. Both prongs include rear-facing, curved surfaces 312. The rear-facing curved surfaces 312 are curved so as to match the curve of the curved surface 108 of the bucket lip 102. The prongs 306, 308 and bridge section 316 also include a forward-facing curved surface 314 that is sized and shaped to fit against an inner surface (e.g., 614, FIG. 6) of the adapter 118. Thus, the curved surface 314 may have a curve that matches the curve of the rear-facing, curved surface 614 of the adapter 118. The curve of the outer surface 314 may be different than the curve of the inner surface 312. The inward-facing surfaces 305 of the prongs 306, 308 are designed to fit against or adjacent the side surfaces 204 of the projection 202. The prongs 306, 308 are sized and shaped to curve around the curved surface 108 of the bucket lip. In the implementation shown, they do this without extending beyond the plane of the bottom surface 106. That is, in the example shown, the prongs include terminal ends that terminate adjacent a lower curved portion of the curved surface 108.

Figure 4:
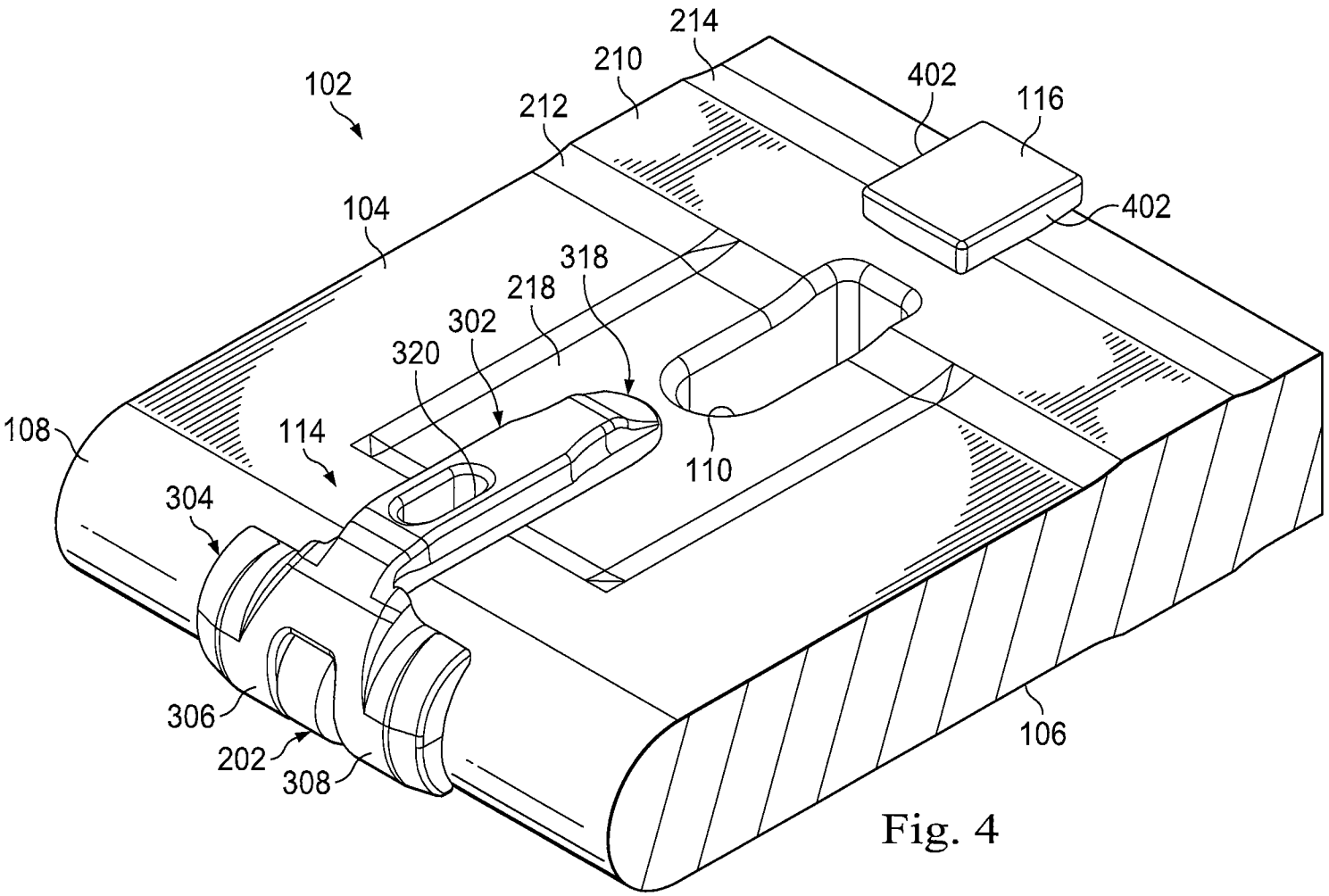
FIG. 4 is a diagram showing a perspective view of the forward stabilizer portion and a rear stabilizer portion of the stabilizer structure on the bucket lip according to one example incorporating principles described herein.

FIG. 4 is a diagram showing the forward stabilizer portion 114 and a rear stabilizer portion 116 of the stabilizer structure 112 on the bucket lip 102. The forward stabilizer portion 114 may be secured to the bucket lip 102 via welding. Additionally, the rear stabilizer portion 116 may be secured to the top surface 104 of the bucket lip 102 via welding.

The rear stabilizer portion 116 may be sized and shaped to fit within a slot (e.g., 704, FIG. 7B) of the adapter 118. For example, the rear stabilizer portion 116 may include outer surfaces 402 that are sized and shaped to fit within the slot and provide stabilizing support to side surfaces (e.g., 708, FIG. 7B) of the slot within the adapter 118. The rear stabilizer portion 116 may be secured to the bucket lip 102 rearward of the anchor hole 110. The rear stabilizer portion 116 may be secured to the bucket lip 102 at least partially on the raised portion 210. The rear stabilizer portion 116 may be substantially rectangular in shape. However, other shapes are contemplated. In some implementations, it is a square or rectangular block having vertically extending side surfaces arranged to be welded or otherwise secured to the bucket lip 102.

Figure 5A:
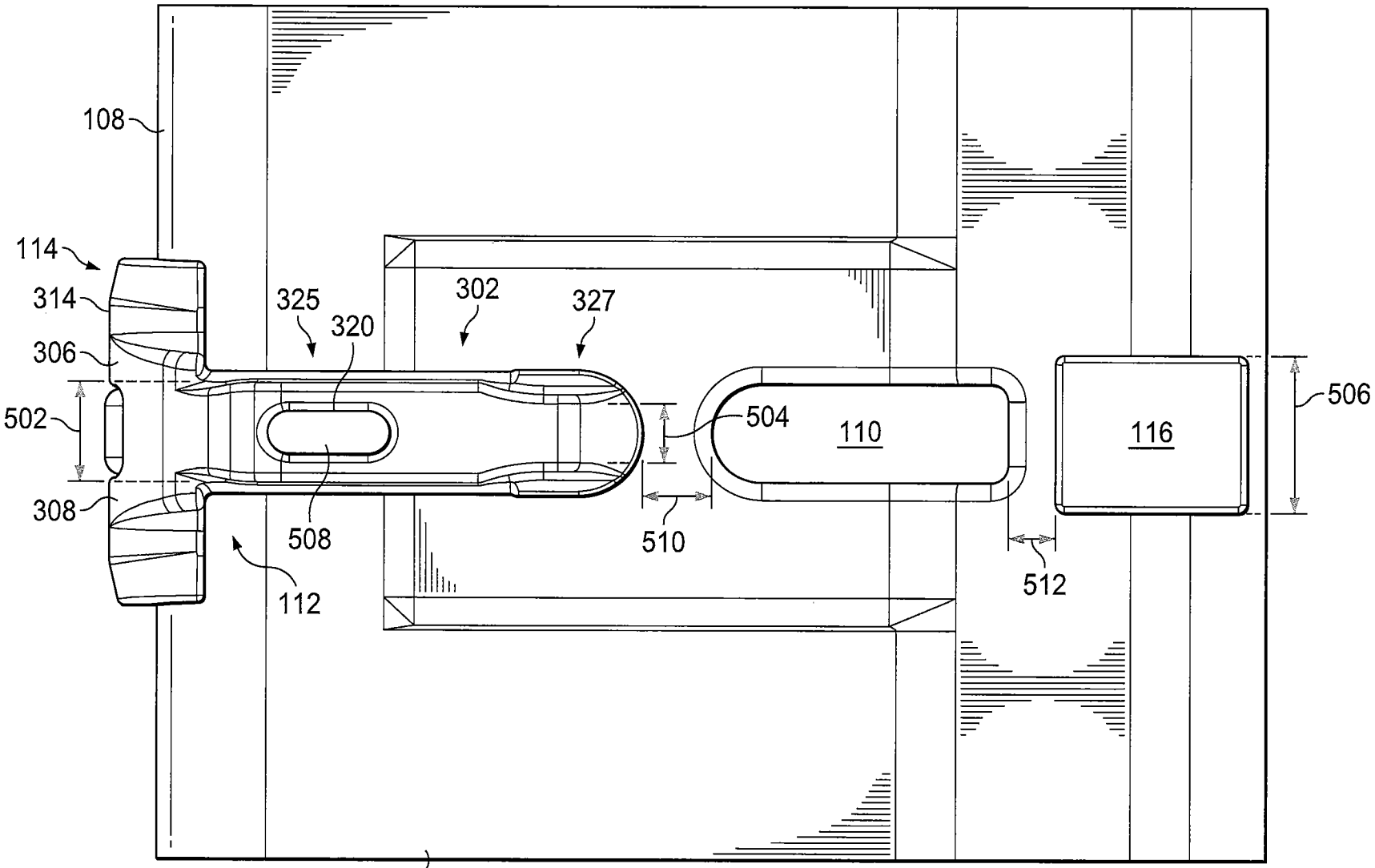
FIG. 5A is a diagram showing a top view of the stabilizer structure on the bucket lip according to an example incorporating principles described herein.

FIG. 5A is a diagram showing a top view of the stabilizer structure 112 on the bucket lip 102. FIG. 5A also illustrates the various widths 502, 504, 506 of the stabilizer structure 112. In the present example, the forward portion 325 of the main body portion 302 of the upper portion 324 of the forward stabilizer portion 114 has a width 502 that is greater than the width 504 of the rear narrow portion 327 of the upper portion 324. Additionally, the width 506 of the rear stabilizer portion is greater than the width 502 of the main body portion 302 of the forward stabilizer portion 114.

FIG. 5A also illustrates a plug weld 508 within the hole 320 of the forward stabilizer portion 114. Thus, the hole 320 provides a mechanism by which the forward stabilizer portion 114 can be better secured to the bucket lip 102. In some examples, the forward stabilizer portion 114 may not have the hole 320 and instead be a solid piece extending along the main body portion 302.

In the present example, the distance 510 between the anchor hole 110 and the forward stabilizer portion 114 is greater than the distance 512 between the anchor hole 110 and the rear stabilizer portion 116. In some examples, the distances 510, 512 between the anchor hole 110 and the stabilizer portions 114, 116 may be different. For example, the anchor hole 110 may be closer to the forward stabilizer portion 114 than the rear stabilizer portion 116.

Figure 5B:
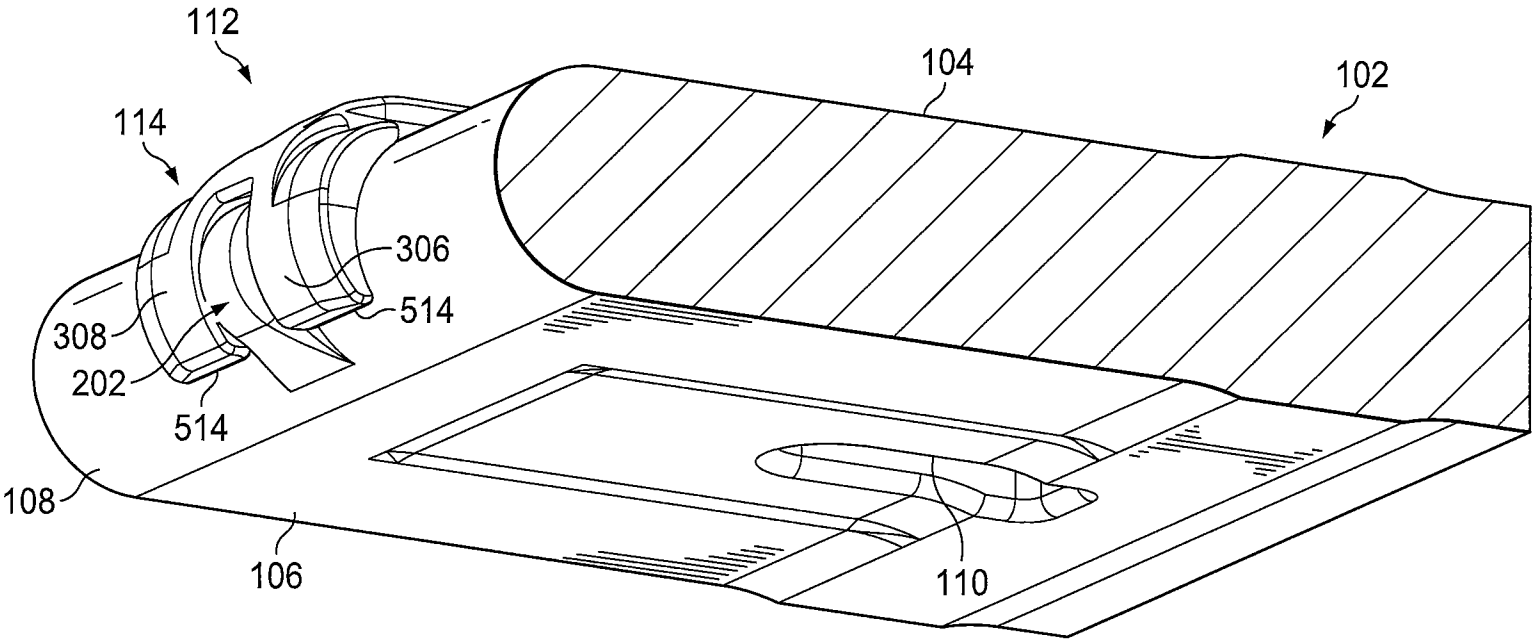
FIG. 5B is a diagram showing a bottom perspective view of the stabilizer structure on the bucket lip according to an example incorporating principles described herein.

FIG. 5B is a diagram showing a bottom perspective view of the stabilizer structure 112 on the bucket lip 102. From the bottom perspective, the prongs 306, 308 can be seen straddling the projection 202. Additionally, the bottom edges 514 of the prongs 306, 308 may be welded to the curved surface 108 of the bucket lip 102.

Figure 6:
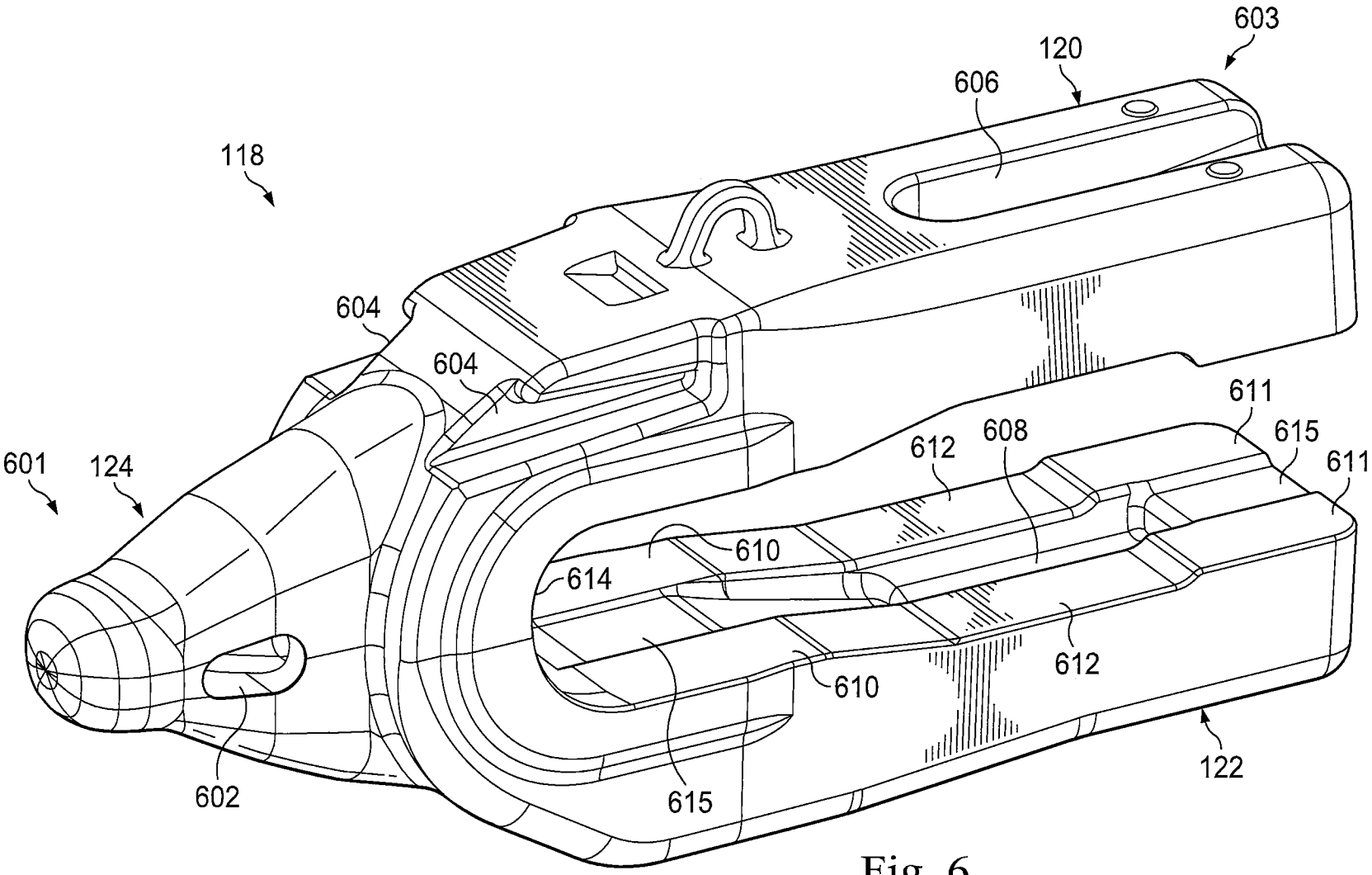
FIG. 6 is a diagram showing a perspective view of the adapter that is received by the stabilizer structure according to an example incorporating principles described herein.

FIG. 6 is a diagram showing a perspective view of the adapter 118 that is stabilized by the stabilizer structure 112. As described above, the adapter 118 includes a pair of bifurcated legs 120, 122 at the proximal end 603 and a nose 124 at the distal end 601. The nose 124 is adapted to be received by an additional wear member, such as an intermediate adapter or a tooth, for example. An example of a wear member will be described in further detail below in the text accompanying FIG. 8. The nose 124 includes a transverse hole 602 through which a connector pin (not shown) may be inserted after the wear member is positioned thereon. In this example shown, the distal end 601 also includes grooves 604 designed to receive a wear cap (not shown).

The proximal end 603 includes a first leg 120 and a second leg 122. The legs 120, 122 are connected via a rear-facing curved surface 614. The rear-facing curved surface 614 may be sized and shaped to abut against the forward-facing curved surface 314 of the forward stabilizer portion 114. The first leg 120 in this implementation is shown as the top leg 120. The second leg 122 in this implementation is shown as the bottom leg 122. The top leg 120 includes a hole 606 through which a wedge member may be inserted. The hole 606 may be sized and shaped to correspond to the anchor hole 110 in the bucket lip 102. The hole 606 is positioned such that when the adapter 118 is properly placed on the bucket lip 102, hole 606 is aligned with anchor hole 110 to allow the wedge member to fit therethrough. Similarly, the bottom leg 122 includes a hole 608 aligned with hole 606 of the top leg 120. Thus, the wedge member may fit through holes 606, 110, and 608 after the adapter 118 is properly placed in the bucket lip 102.

The bottom leg 122 includes engagement surfaces 610, 611. The forward engagement surfaces 610 are designed to abut against the bottom surface 106 of the bucket lip 102. Similarly the rear engagement surfaces 611 are designed to abut against the bottom surface 106 of the bucket lip 102. In some examples, the rear engagement surfaces 611 may be on a different plane than the forward engagement surfaces 610. For example, the rear engagement surfaces 611 may be designed to abut against the raised portion 211 of the bottom surface 106 of the bucket lip 102. The bottom leg 122 also includes non-engagement surfaces 612 positioned between the forward engagement surfaces 610 in the rear engagement surfaces 611. In some examples, the bottom leg 122 may include a shallow groove 615 between the engagement surfaces 610, 611. However, because there is no boss or stabilizer portion on the bottom surface 106 of the bucket 102, the groove 615 may not be designed, or may be too shallow, to receive any bosses or stabilizer portions.

Figure 7A:
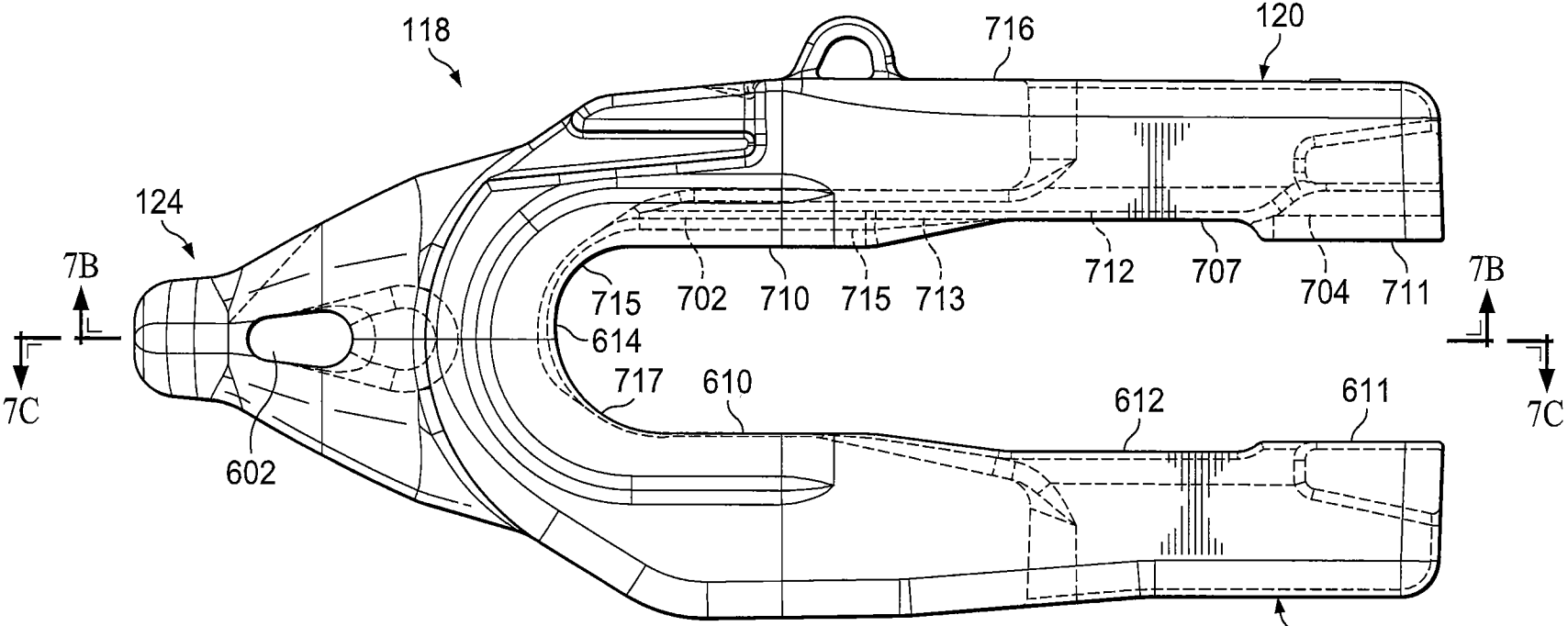
FIG. 7A is diagram showing a side view of the adapter according to an example incorporating principles described herein.
Figure 7B:
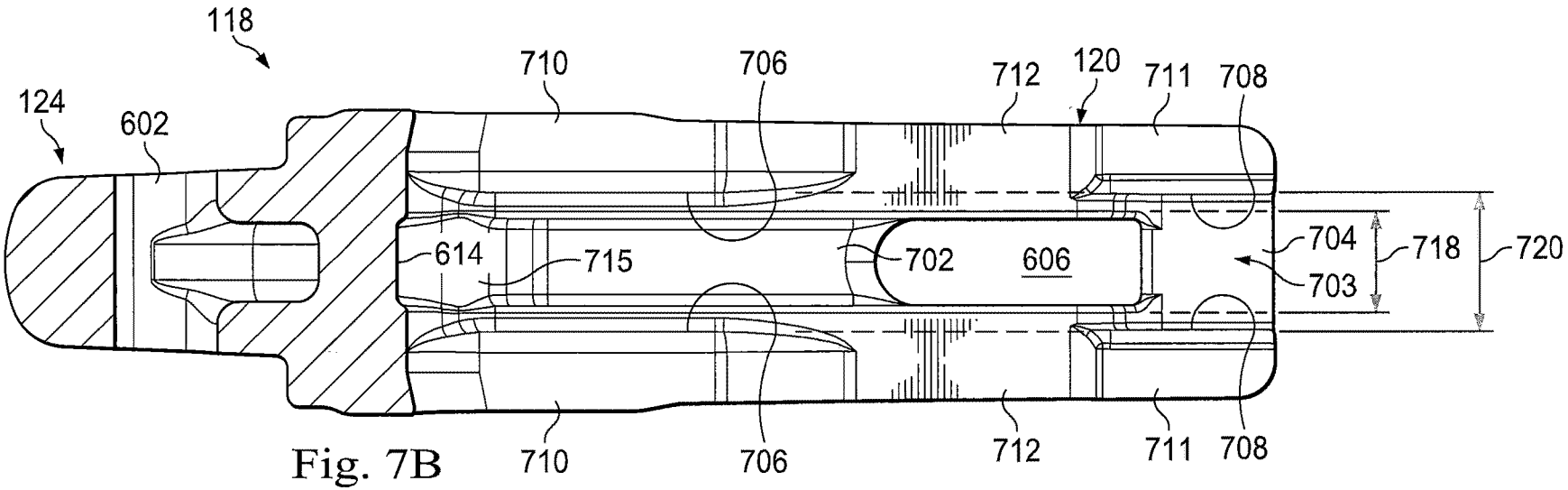
FIG. 7B is diagram showing a cross-sectional view of a top leg of the adapter according to an example incorporating principles described herein.
Figure 7C:
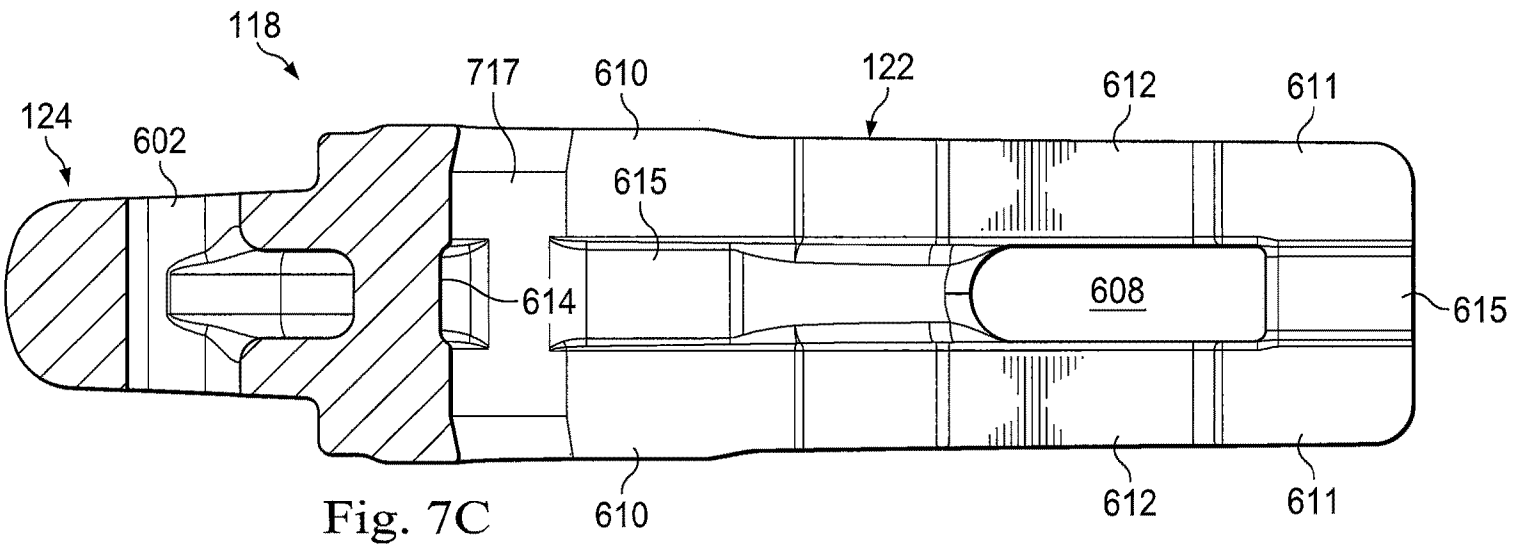
FIG. 7C is diagram showing a cross-sectional view of a bottom leg of the adapter according to an example incorporating principles described herein.

FIG. 7A is diagram showing a side view of the adapter 118. FIG. 7B is diagram showing a cross-sectional view of the top leg 120 of the adapter 118. More particularly, FIG. 7B illustrates a view looking at the inner side of the top leg 120 from a position between the two legs 120, 122. FIG. 7C is diagram showing a cross-sectional view of the bottom leg 122 of the adapter 118. More particularly, FIG. 7C illustrates a view looking at the inner side of the bottom leg 122 from a position between the two legs 120, 122.

Referring to FIGS. 7A-7C, the side view shows the engagement surfaces 610, 611 of the bottom leg 122. The side view also shows similar structures in the top leg 120. For example, the top leg 120 includes engagement surfaces 710, 711. The forward engagement surfaces 710 are designed to abut against the top surface 104 of the bucket lip 102. Similarly the rear engagement surfaces 711 are designed to abut against the top surface 104 of the bucket lip 102. In some examples, the rear engagement surfaces 711 may be on a different plane than the forward engagement surfaces 710. For example, the rear engagement surfaces 711 may be designed to abut against the raised portion 210 of the top surface 104 of the bucket lip 102. The top leg 120 also includes non-engagement surfaces 712 positioned between the forward engagement surfaces 710 in the rear engagement surfaces 711.

The forward-facing curved surface 614 includes an upper portion 715 that curves towards the top leg 120 and a lower portion 717 that curves towards the bottom leg 122. In some examples, the upper portion 715 may be asymmetrical to the lower portion 717. In other words, the upper portion 715 may curve differently than the lower portion 717.

The top leg 120 includes an outer surface 716 and an inner surface 707. The top leg 120 also includes a longitudinal slot 703 extending down the length of the leg 120. The longitudinal slot 703 includes a forward slot 702 and a rear slot 704. The forward slot 702 is positioned between the forward engagement surfaces 710. The rear slot 704 is positioned between the rear engagement surfaces 711. The forward slot 702 is sized and shaped to fit over the forward stabilizer portion 114. More particularly, the forward slot 702 is sized and shaped to fit over the main body portion 302 of the forward stabilizer portion 114. In other words, the forward slot 702 includes side surfaces 706 that abut against the outer surfaces 322 of the upper portion 324 of the forward stabilizer portion 114. The rear slot 704 is sized and shaped to fit over the rear stabilizer portion 116. In other words, the rear slot 704 includes side surfaces 708 that are arranged to fit against the outer surfaces 402 of the rear stabilizer portion 116. In the example where the rear stabilizer portion 116 is wider than the forward stabilizer portion 114, the rear slot 704 may be wider than the forward slot 702.

The forward slot 702 may extend into the upper portion 715 of the forward-facing curved surface 614. In some examples, the forward slot 702 may taper and terminate before it reaches the middle of the forward-facing curved surface 614. The slot 702 may also have a lower slot portion 715 disposed relatively farther from the outer surface 716. The lower slot portion 715 may be sized and shaped to fit against the lower portion 326 of the main body portion 302. The forward slot 702 may also have an upper slot portion 713 disposed relatively farther from the outer surface 716. The upper slot portion 713 may be sized and shaped to receive the upper portion 324 of the main body portion 302. The width 718 of the upper slot portion may be less than the width 720 of the lower slot portion.

Figure 8:
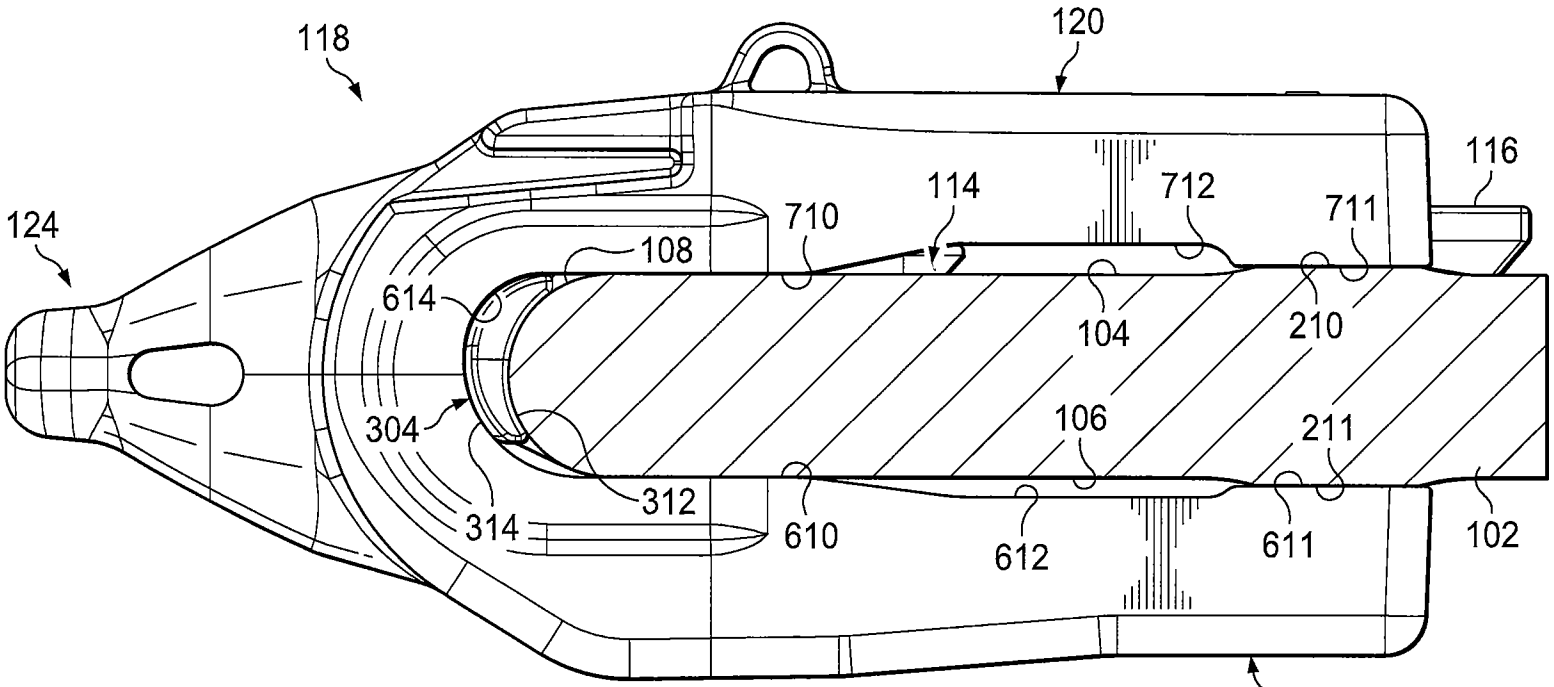
FIG. 8 is a diagram showing a side view of the wear member assembly with the adapter secured over the stabilizer structure and to the bucket lip according to an example incorporating principles described herein.

FIG. 8 is a diagram showing the adapter 118 secured to the bucket lip 102. As illustrated, the forward portion 304 of the forward stabilizer portion 114 is positioned between the curved surface 108 of the bucket lip 102 and the adapter 118. More specifically, the rear-facing surface 614 of the adapter 118 abuts against the outer surface 314 of the forward stabilizer portion 114. Additionally, the inner surface 312 of the forward stabilizer portion 114 is positioned against the curved surface of the bucket lip 102.

The legs 120, 122 abut against the bucket lip 102 as well. Specifically, the forward engagement surfaces 710 engage the top surface 104 of the bucket lip 102 and the forward engagement surfaces 610 engage the bottom surface 106 of the bucket lip 102. Additionally, the rear engagement surfaces 711 engage the raised portion 210 of the bucket lip 102 and the rear engagement surfaces 611 engage the raised portion 211 of the bucket lip 102. The main body portion 302 (only partially shown in this perspective) of the forward stabilizer portion 114 fits within the forward slot 702 and the rear stabilizer portion 116 fits within the rear slot 704.

As can be seen in FIG. 8, the inner surface 312 of the forward stabilizer portion 114 has a different curve than the outer surface 314. Moreover, the curve of the outer surface 314 is not aligned with the curve of the inner surface 312 so as to create a lobe shape in the forward portion 304 of the forward stabilizer portion 114.

Figure 9:
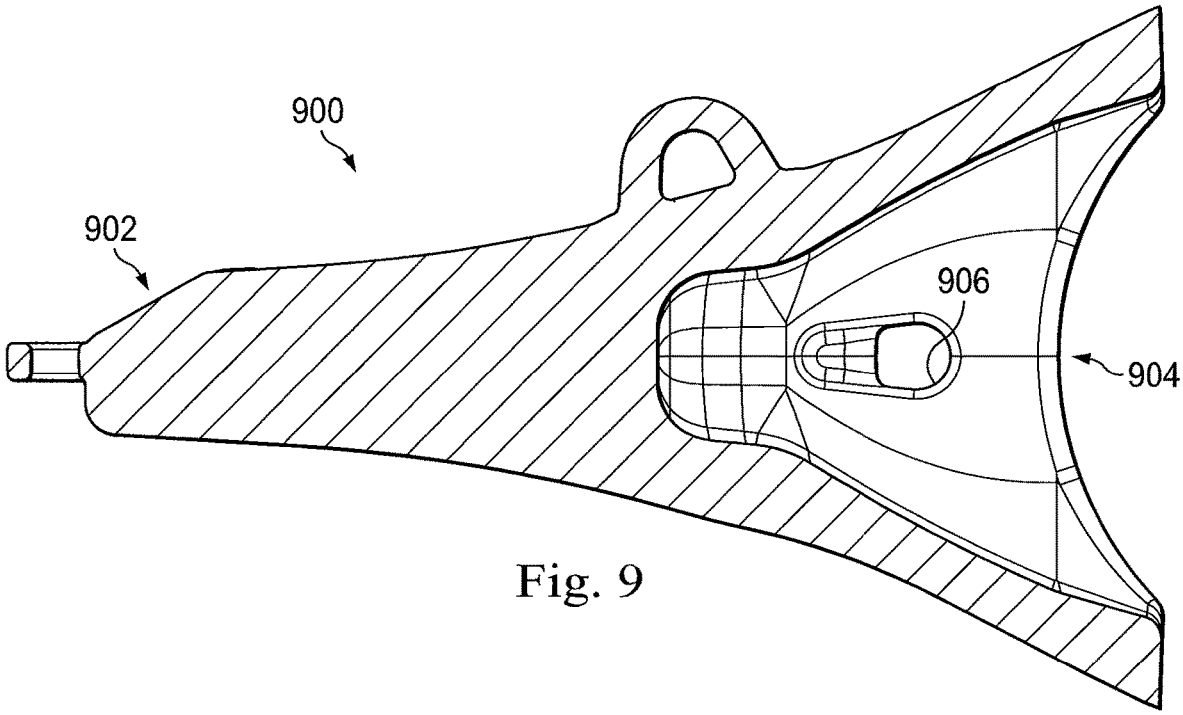
FIG. 9 is a diagram showing a cross-sectional view of an illustrative wear member that fits on the adapter according to an example incorporating principles described herein.

FIG. 9 is a diagram showing a cross-sectional view of an illustrative wear member 900 that fits on the adapter 118. In FIG. 9, the wear member 900 is a ground engaging tool, such as a tooth. The wear member 900 includes a rear-facing cavity 904 that is sized and shaped to fit over the adapter nose 124. The wear member 900 also includes a pair of transverse holes 906 on both sides of the wear member 900. The holes 906 align with the hole 602 in the adapter nose 124 such that a connector pin can be inserted therethrough. With the wear member 900 secured to the adapter 118, and the adapter 118 secured to the bucket lip 102, the digging edge 902 of the wear member can be engaged with the ground. After a certain amount of wear, the wear member 900 can be replaced without having to replace the adapter. Over time, the adapter 118 may also wear along with the various other wear members connected thereto, and thus the adapter 118 may need to be replaced without having to replace the bucket lip 102.

In some examples, the adapter 118 may include an integrated wear component that is designed to engage the ground. In other words, instead of the nose 124, the distal end of the adapter 118 may include a ground engaging end. After a certain amount of wear occurs, the adapter 118 with its ground engaging end may be replaced.

Figure 10:
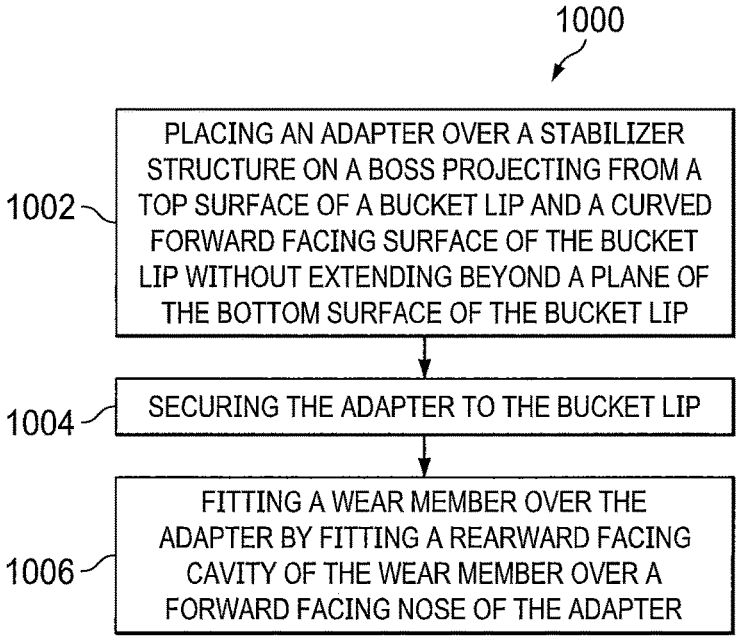
FIG. 10 is a flowchart showing an illustrative method for using a stabilizer structure to connect an adapter to a bucket lip according to an example incorporating principles described herein.

FIG. 10 is a flowchart showing an illustrative method for using a stabilizer structure to secure an adapter to a bucket lip. According to the present example, the method 1000 includes a step 1002 for placing an adapter rearward over a bucket lip. The adapter may have a pair of bifurcated legs that straddle the bucket lip. One of the legs may have a slot for fitting onto a stabilizer structure on the bucket lip. The stabilizer structure may include a forward stabilizer portion projecting from a top surface of the bucket lip and extending over a curved forward facing surface of the bucket lip without extending beyond a plane of the bottom surface of the bucket lip. In some examples, the forward stabilizer portion may be welded to the bucket lip. The bucket lip may also have welded to it a rear stabilizer portion positioned rearward of the forward stabilizer portion.

The method 1000 may further include a step 1004 for securing the adapter to the bucket lip. This may be done by inserting a wedge member through holes of the legs and an anchor hole on the bucket lip. In some implementations, the wedge member may include a lock formed of a c-shaped piece and a wedge-shaped piece, although other locks are contemplated.

The method 1000 may further include a step 1006 for fitting a wear member over the adapter by fitting a rearward facing cavity of the wear member over a forward facing nose of the adapter. With the wear member secured, the wear member assembly may be used for ground engaging operations.

FIGS. 11-18 illustrate another embodiment of a stabilizer structure. This embodiment is similar in many ways to the embodiment illustrated in FIGS. 1-8. Accordingly, the following description will not re-describe all similar features, as the relevant descriptions of FIGS. 1-8 also apply to FIGS. 11-18. Instead, the following description will focus on the variations between the embodiment of FIGS. 1-8 and the embodiment of FIGS. 11-18.

Figure 11:
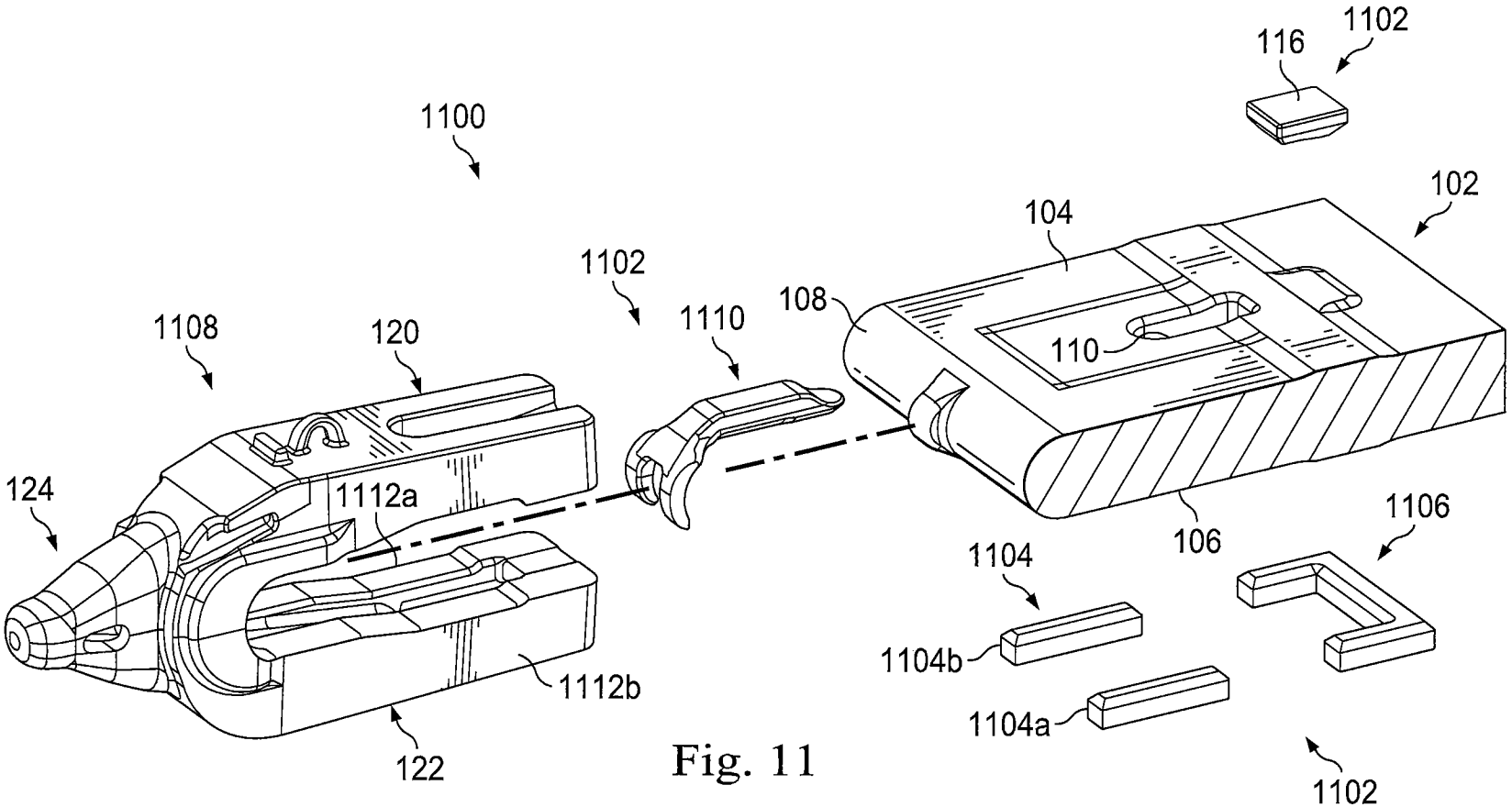
FIG. 11 is a diagram showing an exploded view of a wear member assembly including a stabilizer structure for securing an adapter to a bucket lip according to an example incorporating principles described herein.

FIG. 11 is a diagram showing an exploded view of a wear member assembly 1100 including a stabilizer structure 1102 for securing an adapter 1108 to the bucket lip 102. In the present example, the stabilizing structure 1102 includes a forward-top stabilizer portion 1110 and a rear stabilizer portion 116. The forward-top stabilizer portion 1110 is similar, though not identical, to the forward stabilizer 114 (FIG. 1). The differences between the forward-top stabilizer portion 1110 and the forward stabilizer 114 will be discussed in greater detail below with the text accompanying FIG. 12.

The stabilizing structure 1102 further includes a forward-bottom stabilizer portion 1104 and a rearward-bottom stabilizer portion 1106. The forward stabilizer portion 1104 includes a first portion 1104*a* and a second portion 1104*b*. Both the first portion 1104*a* and the second portion 1104*b* may be elongated elements formed of a rigid material such as a metal material. Accordingly, the first portion 1104*a* and the second portion 1104*b* of the forward-bottom stabilizer structure 1104 may be formed of solid, rigid metal bars. The portions 1104*a*, 1104*b* may be welded in place to the bottom 106 of the bucket lip 102. When the adapter 1108 is operably disposed on the lip 102, the portions 1104*a*, 1104*b* may abut against side surfaces 1112*a*, 1112*b* of the adapter 1108 to provide additional support to the bottom leg 122.

The rearward-bottom stabilizer portion 1106 may be a generally u-shaped device formed of a rigid material such as a metal material. The rearward-bottom stabilizer portion 1106 may also be welded to the bottom 106 of the bucket lip 102. The rearward-bottom stabilizer portion 1106 may be sized and shaped to receive the bottom leg 122 of the adapter 1108.

Figure 12:
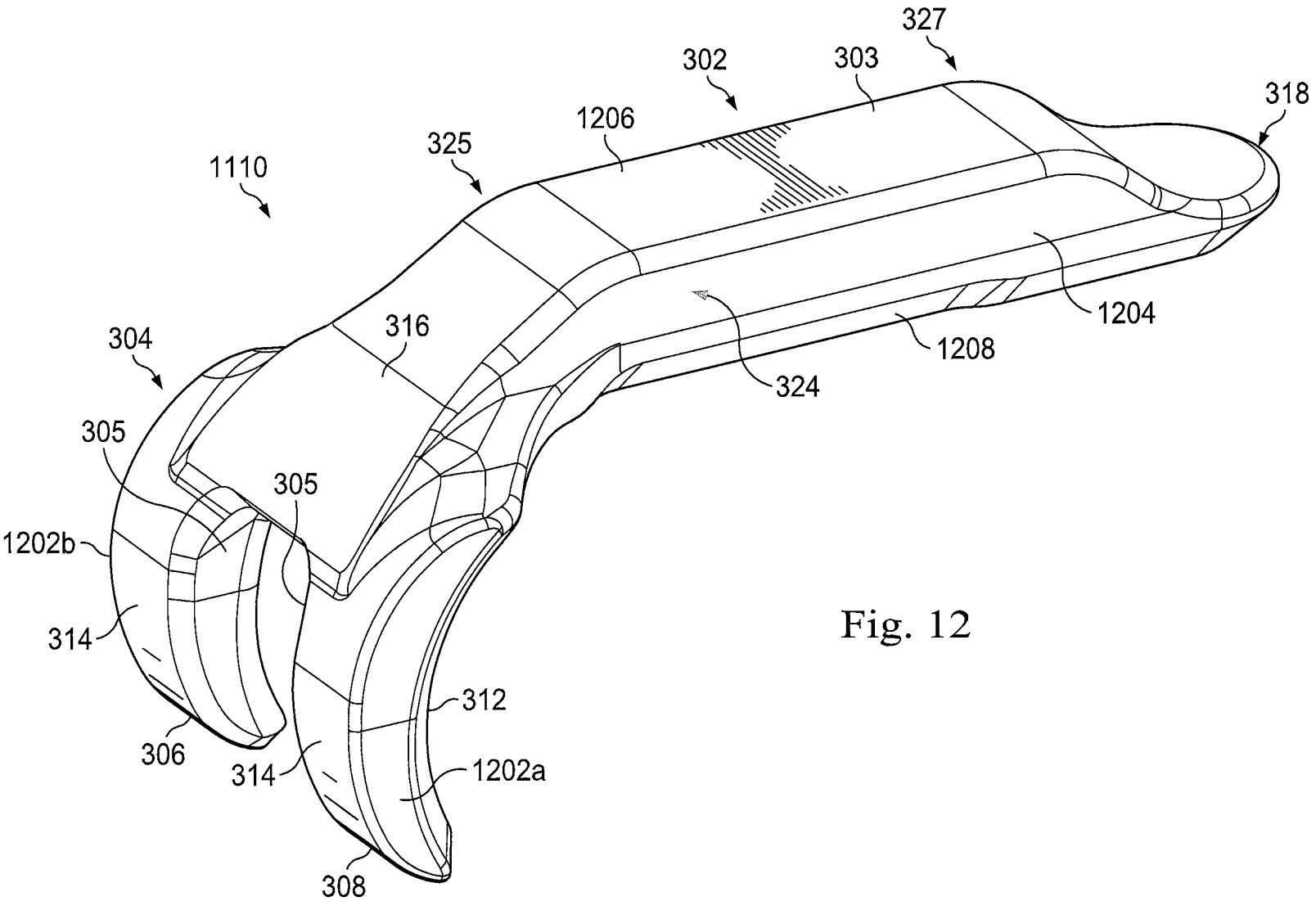
FIG. 12 is a diagram showing a perspective view of a forward stabilizer portion of a stabilizer structure according to an example incorporating principles described herein.

FIG. 12 is a diagram showing a perspective view of a forward-top stabilizer portion 1110 of the stabilizer structure 1102. Like the forward stabilizer 114, the forward-top stabilizer 1110 includes two prongs 306, 308. However, the prongs 306, 308 in the forward-top stabilizer portion 1110 are narrower than the prongs 306, 308 in the forward stabilizer 114. Additionally, the prongs 306, 308 of the forward-top stabilizer portion 1110 have planar side surfaces 1202*a*, 1202*b* for supporting inner side surfaces of the adapter 1108, as will be explained in further detail below.

The forward-top stabilizer portion 1110 also includes a top surface 1206 without a hole (e.g., 320, FIG. 3) formed therein. Moreover, the upper portion 324 of the main body portion 302 includes planar side surfaces 1204. The planar side surfaces 1204 extend substantially perpendicular from the top surface 1206 of the main body portion 302. These side surfaces 1204 may provide stabilizing lateral support to the adapter legs. In this implementation, the forward-top stabilizer portion 1110 may include a base surface 1208 disposed adjacent the side surface 1204. In some implementations, the base surface 1208 may taper inwardly toward the bottom, lip-contacting surface of the forward-top stabilizer portion 1110, and in some instances the base surface 1208 is substantially planar and flush with the side surfaces 1204. When tapered, the base surface 1208 may facilitate welding by receiving a welding bead that secures the forward-top stabilizer portion 1110 to the lip 102.

Figure 13:
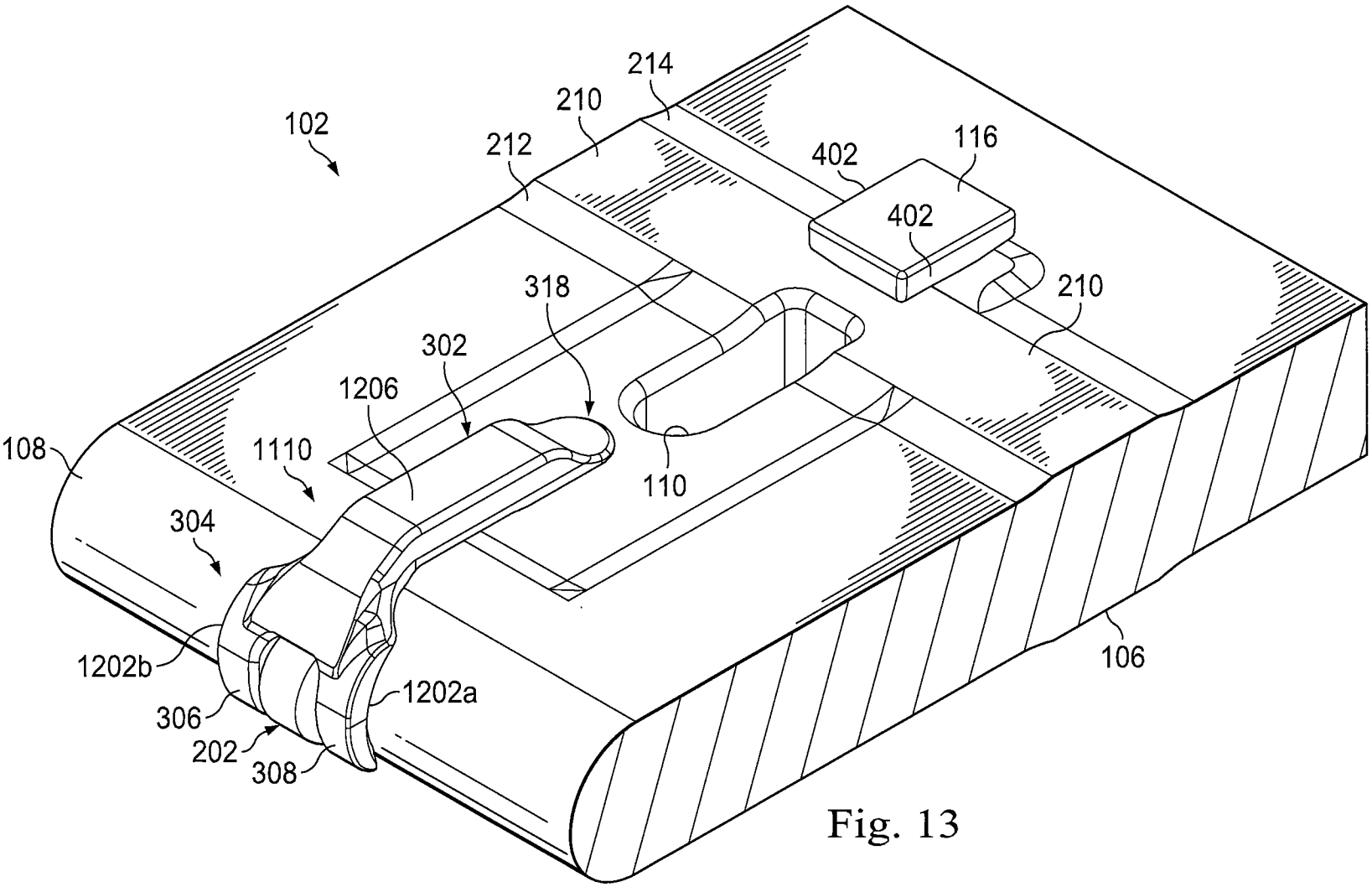
FIG. 13 is a diagram showing a perspective view of the forward stabilizer portion and a rear stabilizer portion of the stabilizer structure on the bucket lip according to one example incorporating principles described herein.

FIG. 13 is a diagram showing a perspective view of the forward-top stabilizer portion 1110 and the rear stabilizer portion 116 of the stabilizer structure 1102 on the bucket lip 102.

Figure 14A:
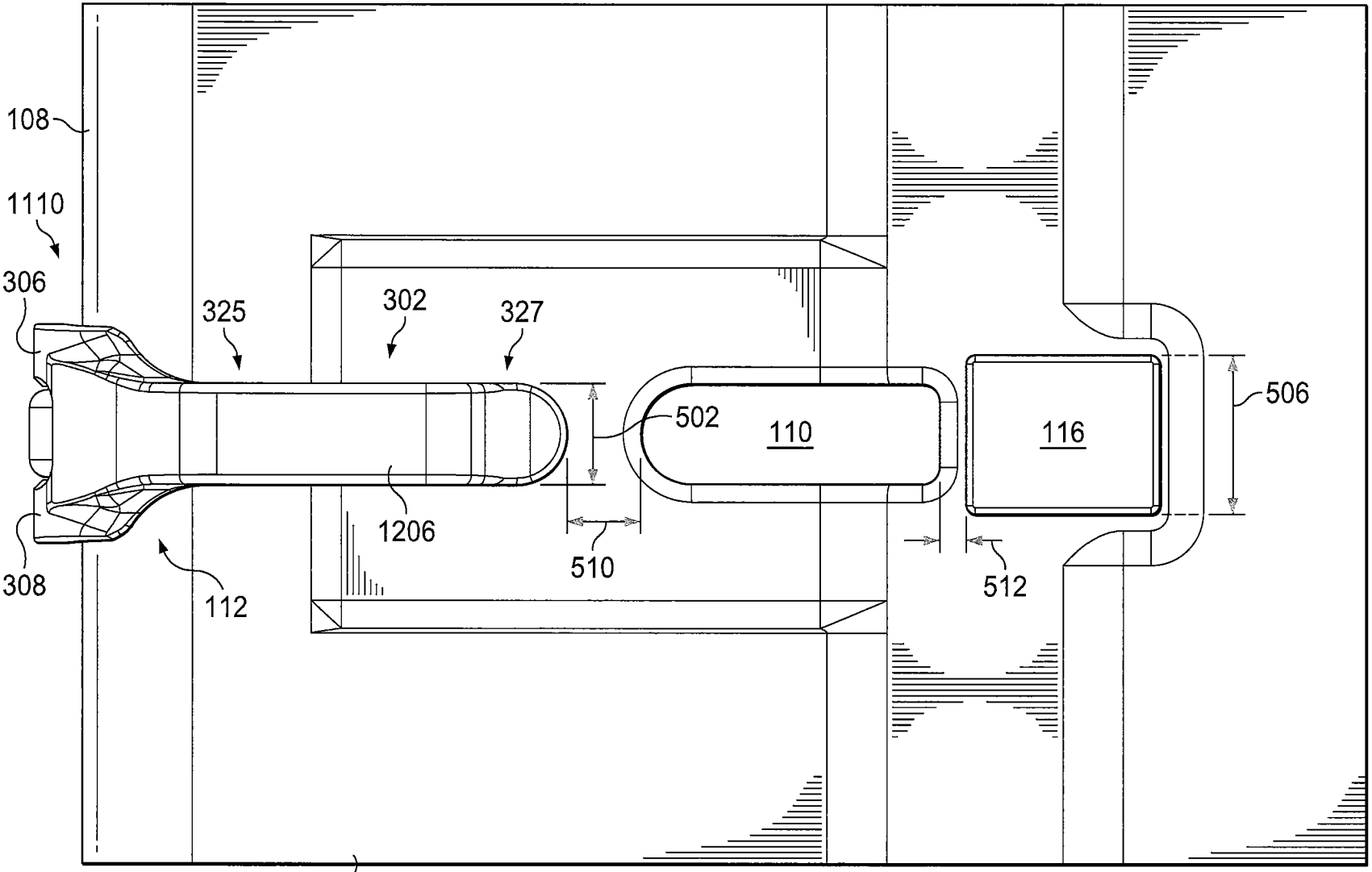
FIG. 14A is a diagram showing a top view of the stabilizer structure on the bucket lip according to an example incorporating principles described herein.
Figure 14B:
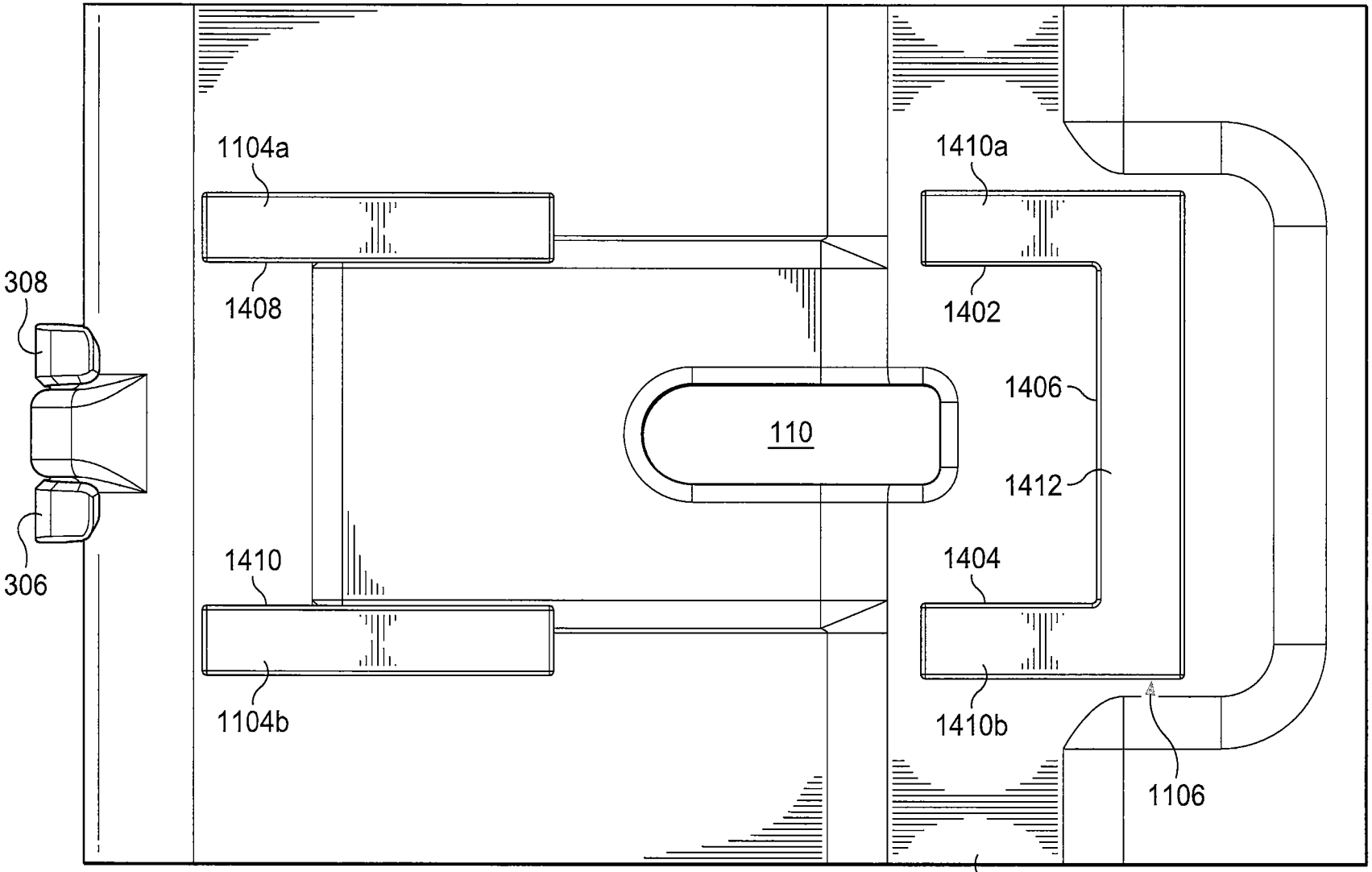
FIG. 14B is a diagram showing a bottom perspective view of the stabilizer structure on the bucket lip according to an example incorporating principles described herein.

FIG. 14A is a diagram showing a top view of the stabilizer structure 1102 on the bucket lip 102. FIG. 14B is a diagram showing a bottom view of the stabilizer 1102 structure on the bucket lip 102. As described above, the forward-bottom stabilizer portion 1104 includes a first portion 1104*a* and a second portion 1104*b*. The first portion 1104*a* has an inward facing side surface 1408 to provide support to the side surface 1112*a* of the adapter 1108. The second portion 1104*b* also has an inward facing side surface 1410 to provide support to and abut against side surface 1112*b* of the adapter 1108.

The rearward-bottom stabilizer portion 1106 includes two side portions 1410*a*, 1410*b* and a back portion 1412. In some embodiments, the rearward-bottom stabilizer portion 1106 is a metal bar that is welded in place to provide stabilizing lateral support to a rear portion of the adapter. The first side portion 1410*a* has an inward facing surface 1402 to provide support to and to abut against the side surface 1112*a* of the adapter 1108. Additionally, the second side portion 1410*b* has an inward facing surface 1404 to provide support and abut against side surface 1112*b* of the adapter. In this embodiment, the back portion 1412 has a forward facing surface 1406 that does not abut against the back surface of the adapter 1108, but may be utilized to connect the first and second side portions 1410*a* and 1410*b* and provide few separate components to simplify manufacturing. The forward facing surface 1406 is disposed to provide a gap between the back surface of the adapter so that longitudinal support for the adapter occurs primarily at the edge of the lip 102. In this embodiment, the surfaces 1402 and 1408 are substantially parallel to each other, and may in some embodiments, lie in the same plane. Likewise, the surfaces 1404 and 1410 may be substantially parallel and may in some embodiments, lie in the same plane.

Figure 15:
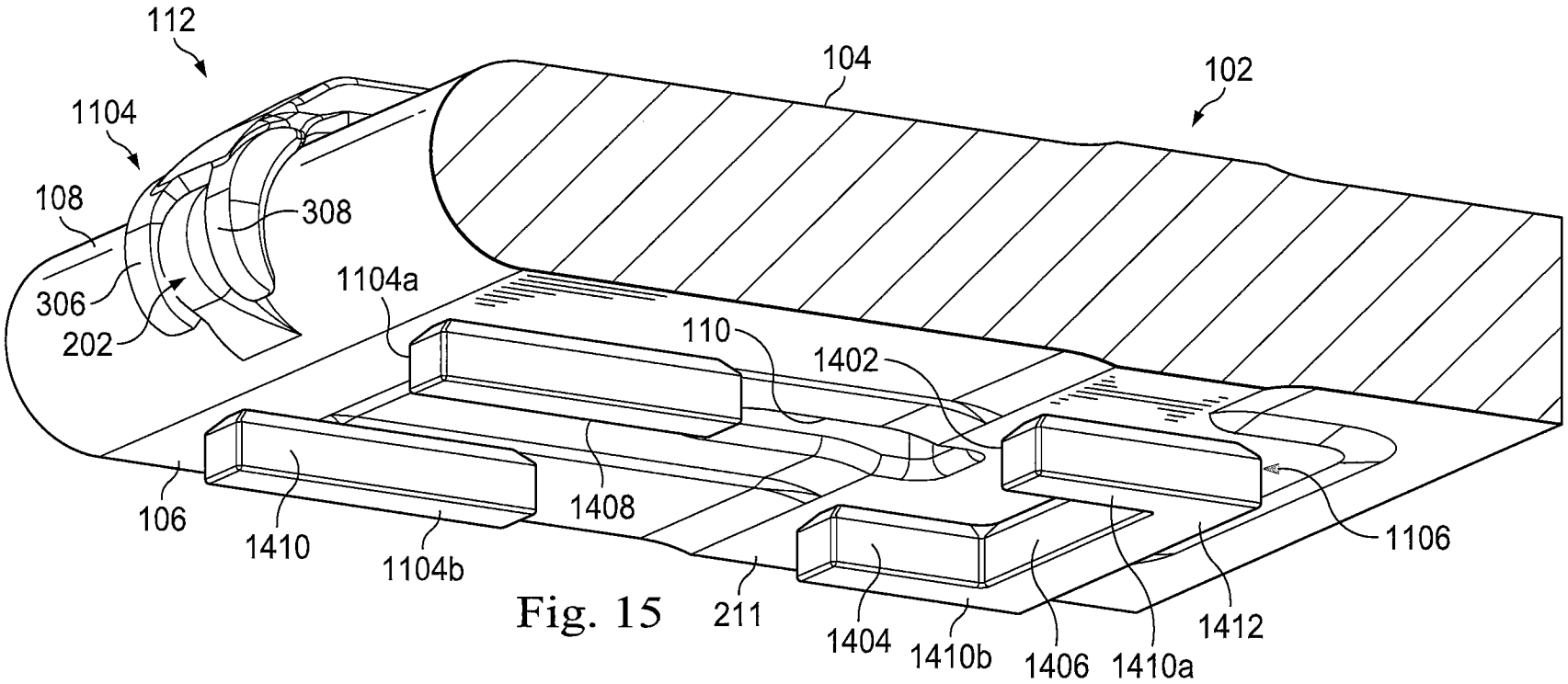
FIG. 15 is a diagram showing a perspective view of the bottom of the bucket lip and the stabilizing features thereon according to an example incorporating principles described herein.

FIG. 15 is a diagram showing a perspective view of the bottom surface 106 of the bucket lip 102 and the stabilizing structure 1102 disposed thereon. As can be seen, the first portion 1104*a* and a second portion 1104*b* are disposed at the lip-side of the anchor hole 110, and the rearward-bottom stabilizer portion 1106 is disposed behind the anchor hole 110.

Figure 16:
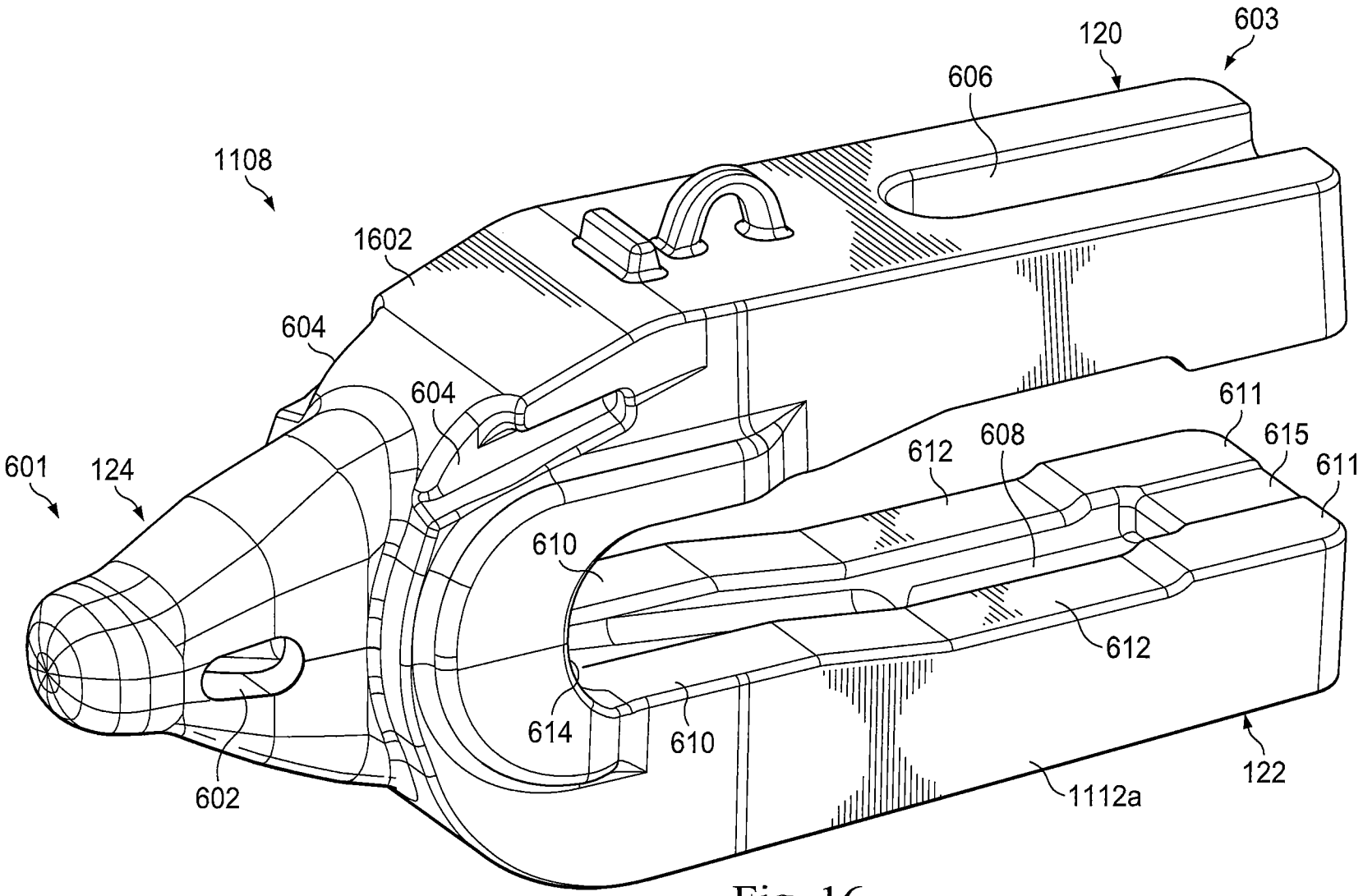
FIG. 16 is a diagram showing a perspective view of the adapter that is received by the stabilizer structure according to an example incorporating principles described herein.

FIG. 16 is a diagram showing a perspective view of the adapter that is received by the stabilizer structure. The adapter 1108 has a smooth, planar surface 1602 that faces in a forward direction.

Figure 17A:
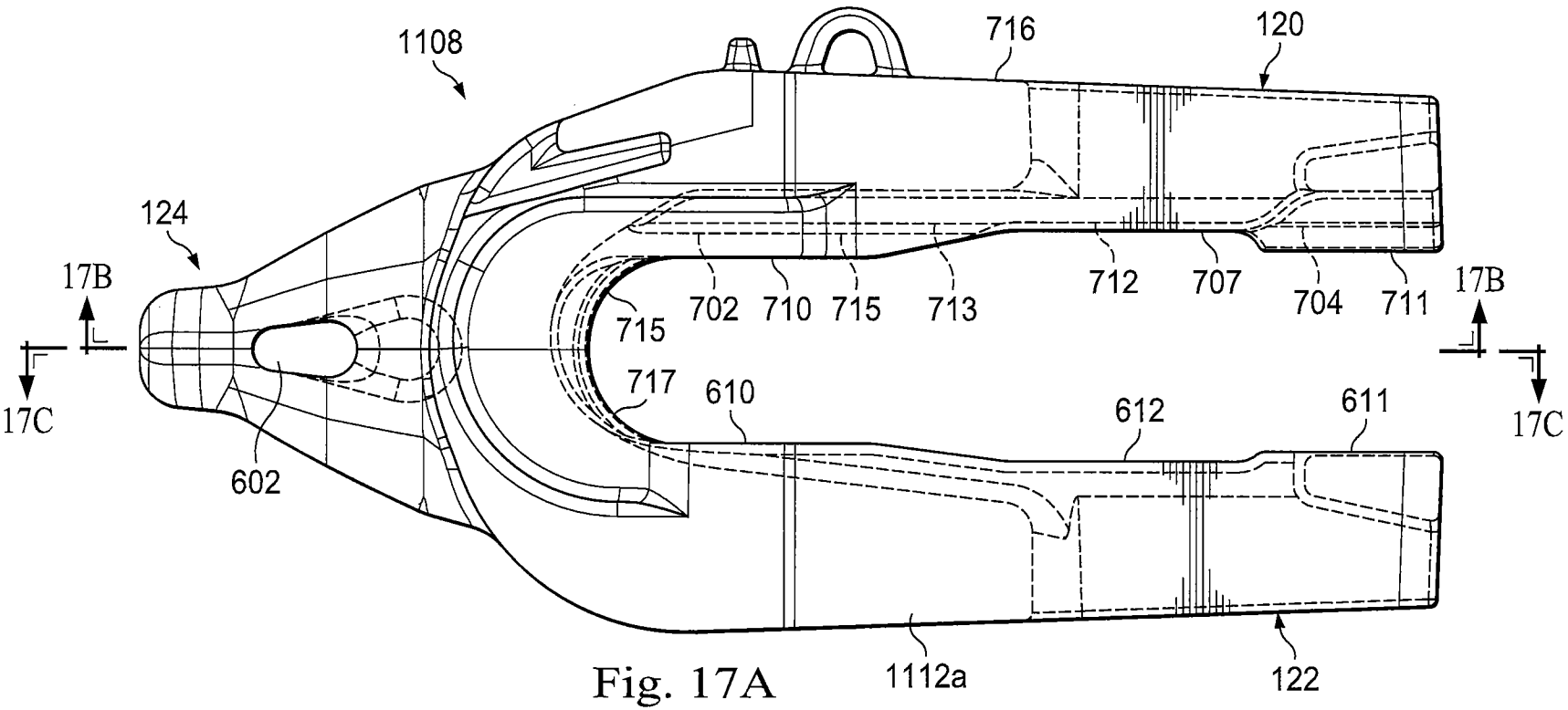
FIG. 17A is diagram showing a side view of the adapter according to an example incorporating principles described herein.
Figure 17B:
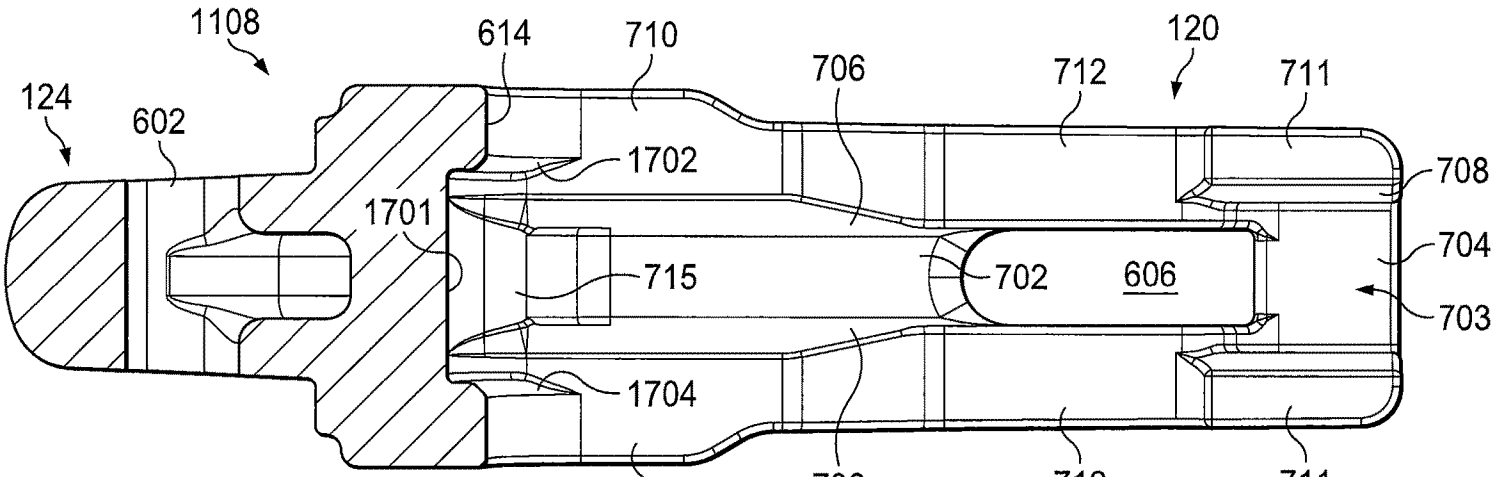
FIG. 17B is diagram showing a cross-sectional view of the adapter of FIG. 17A and showing an inner surface of a top leg of the adapter according to an example incorporating principles described herein.
Figure 17C:
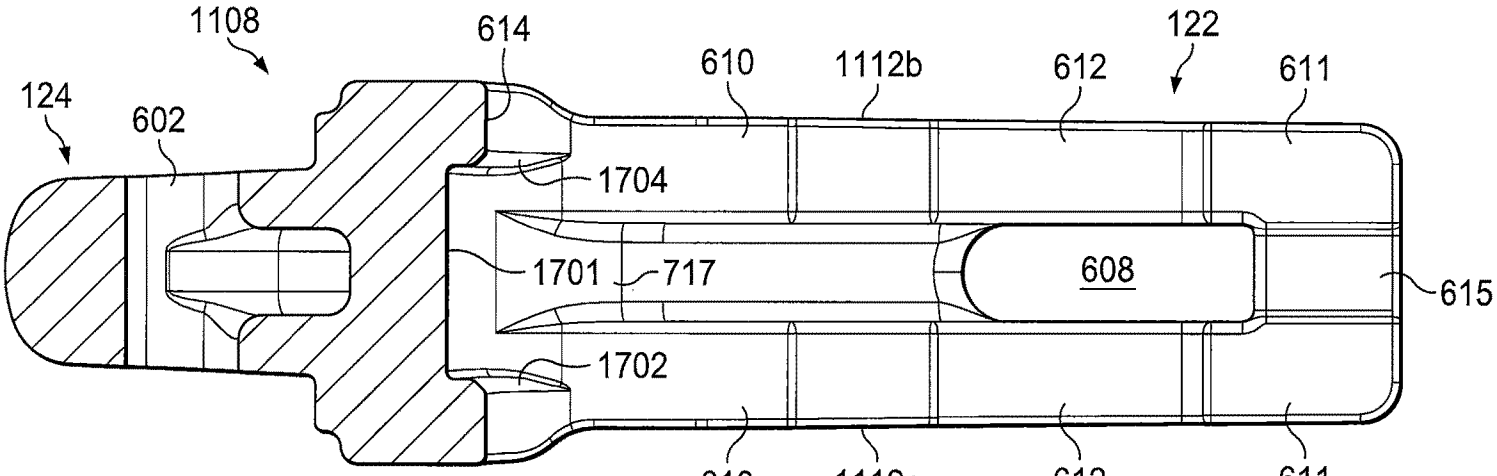
FIG. 17C is diagram showing a cross-sectional view of the adapter of FIG. 17A and showing an inner surface of a bottom leg of the adapter according to an example incorporating principles described herein.
Figure 18:
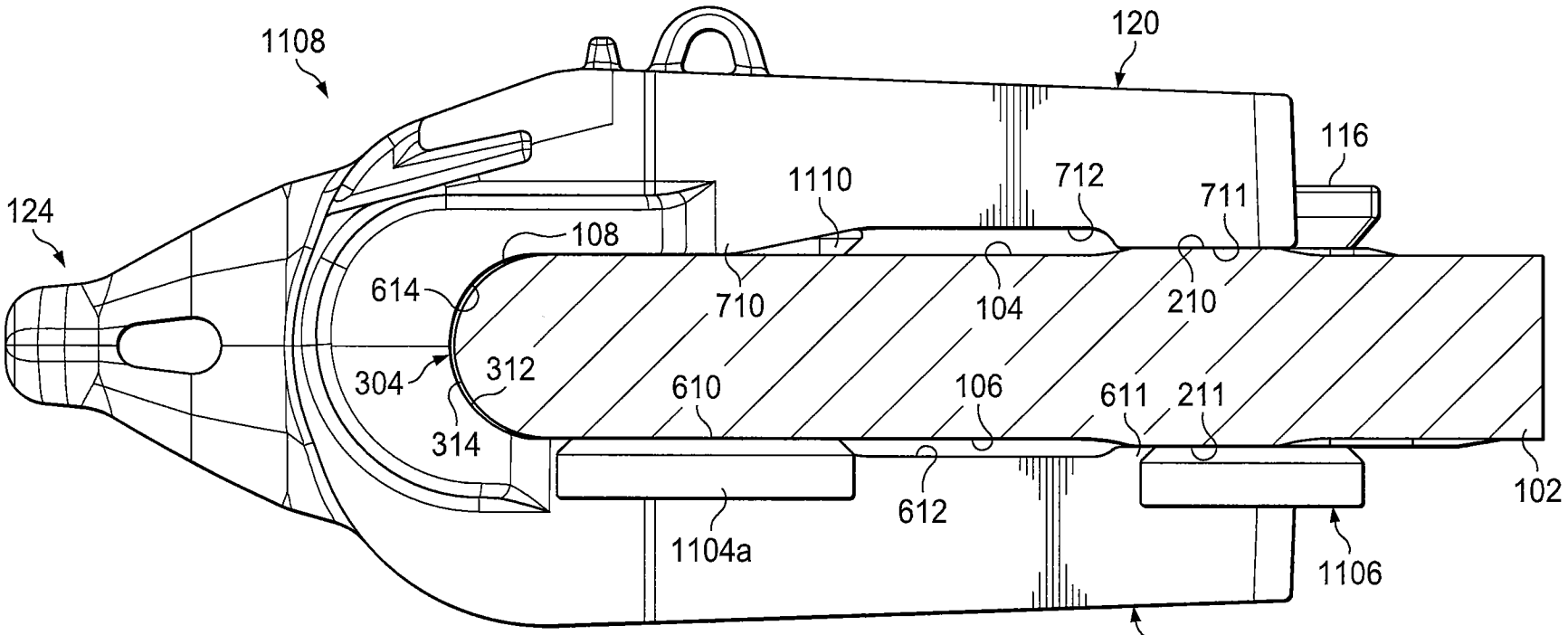
FIG. 18 is a diagram showing a side view of the wear member assembly with the adapter secured over the stabilizer structure and to the bucket lip according to an example incorporating principles described herein.

FIG. 17A is diagram showing a side view of the adapter 1108. FIG. 17B is diagram showing a cross-sectional view of the adapter of FIG. 17A and showing an inner surface of the top leg 120 of the adapter 1108. FIG. 17C is diagram showing a cross-sectional view of the adapter of FIG. 17A and showing an inner surface of the bottom leg 122 of the adapter 1108. With reference to these Figures, the forward-facing curved surface 614 of the adapter connects the upper portion and the lower portion and includes the upper portion 715 that curves towards the top leg 120 and a lower portion 717 that curves towards the bottom leg 122. In the example shown, the upper portion 715 may be symmetrical to the lower portion 717, and may curve to correspond to the arc or radius of the bucket lip 108. However, within the example embodiment shown, an inner surface 1701 is shaped to extend about and abut against the curved surface 314 of the two prongs 306, 308 (FIG. 12). That is, the inner surface 1701 may have a curve that matches the curved surface 314. In this embodiment, the adapter 1108 includes a cavity formed by the inner surface 1701 and inward facing side surfaces 1702, 1704. The cavity of the adapter receives the prongs 306, 308 of the forward-top stabilizer portion 1110, and the forward-top stabilizer portion 1110 provides stabilizing support to the adapter during use. In this embodiment, the inward facing side surface 1702 may abut against side surface 1202*a* of the forward-top stabilizer portion 1110. Likewise, the inward facing side surface 1704 may abut against side surface 1202*b* of the forward-top stabilizer portion 1110. Accordingly, the forward-top stabilizer portion 1110 may provide lateral support to the adapter along the lip 108 of the bucket 102, as well as along the top and bottom surface. FIG. 18 is a diagram showing a side view of the wear member assembly with the adapter 1108 secured over the stabilizer structure 1102 and to the bucket lip 102. As can be seen in this embodiment, the forward-top stabilizer portion 1110 is substantially protected or shielded by the adapter at the curved surface 108 of the bucket edge.

Persons of ordinary skill in the art will appreciate that the implementations encompassed by the present disclosure are not limited to the particular exemplary implementations described above. In that regard, although illustrative implementations have been shown and described, a wide range of modification, change, combination, and substitution is contemplated in the foregoing disclosure. It is understood that such variations may be made to the foregoing without departing from the scope of the present disclosure. Accordingly, it is appropriate that the appended claims be construed broadly and in a manner consistent with the present disclosure.

What is claimed is:

1. A stabilizer structure for equipment having a lip, the stabilizer structure comprising:

an elongated main body portion comprising:

an upper portion configured to be coupled to a top surface of the lip, the upper portion comprising outward-facing side surfaces defining a first width of the upper portion; and a forward portion configured to be coupled to a curved surface of the lip, the forward portion comprising:

a forward-facing curved surface having a radius of curvature; and a rear-facing curved surface shaped to abut against the curved surface of the lip, the rear-facing curved surface including a different radius of curvature than the forward-facing curved surface, wherein a terminal end of the forward portion is sized to terminate adjacent the curved surface of the lip.

2. The stabilizer structure of claim 1, wherein the first width of the upper portion is consistent along a length of the upper portion.

3. The stabilizer structure of claim 1, wherein the outward-facing side surfaces are substantially parallel.

4. The stabilizer structure of claim 1, wherein the forward portion comprises an upper portion and a lower portion, and wherein a radial thickness of the upper portion is greater than a radial thickness of the lower portion.

5. The stabilizer structure of claim 1, further comprising a rear stabilizer portion spaced apart from the main body portion.

6. The stabilizer structure of claim 5, wherein the main body portion is configured to be positioned forward of an anchor hole in the lip, and wherein the rear stabilizer portion is configured to be spaced apart from the main body portion and positioned rearward of the anchor hole.

7. The stabilizer structure of claim 1, further comprising a bottom stabilizer portion separate from the main body portion and configured to be coupled to a bottom surface of the lip.

8. The stabilizer structure of claim 7, wherein the bottom stabilizer portion comprises inward-facing side surfaces configured to abut against outward-facing side surfaces of an adapter when the bottom stabilizer portion is coupled to the bottom surface of the lip.

9. The stabilizer structure of claim 7, wherein the bottom stabilizer portion includes a rearward stabilizer portion and a forward stabilizer portion, the rearward stabilizer portion being spaced apart from the forward stabilizer portion.

10. The stabilizer structure of claim 1, wherein a proximal end of the upper portion, opposite the forward portion, includes a rounded edge.

11. The stabilizer structure of claim 1, wherein the forward portion further comprises:

a bridge section;

a first prong extending from the bridge section; and a second prong extending from the bridge section, wherein the bridge section, the first prong, and the second prong each include the forward-facing curved surface and the rear-facing curved surface.

12. The stabilizer structure of claim 1, wherein the upper portion further comprises a rearward top surface and a forward top surface, the rearward top surface and the forward top surface both positioned between the forward portion and a rear end of the upper portion, wherein the forward top surface is angled downward relative to the rearward top surface.

13. A stabilizer structure for equipment having a lip, the stabilizer structure comprising:

an elongated main body portion comprising:

an upper portion configured to be coupled to a top surface of the lip, the upper portion comprising outward-facing side surfaces; and a forward portion configured to be coupled to a curved surface of the lip, the forward portion comprising:

a forward-facing curved surface;

a rear-facing curved surface;

a bridge section;

a first prong extending from the bridge section; and a second prong extending from the bridge section, wherein the bridge section, the first prong, and the second prong each include the forward-facing curved surface and the rear-facing curved surface, and wherein a terminal end of the forward portion is sized to terminate adjacent the curved surface of the lip.

14. The stabilizer structure of claim 13, wherein the rear-facing curved surface includes a different curve than the forward-facing curved surface.

15. The stabilizer structure of claim 13, wherein the forward portion comprises an upper portion and a lower portion, and wherein a radial thickness of the upper portion is greater than a radial thickness of the lower portion.

16. The stabilizer structure of claim 13, further comprising a rear stabilizer portion, wherein the main body portion is configured to be positioned forward of an anchor hole in the lip, and wherein the rear stabilizer portion is configured to be positioned rearward of the anchor hole.

17. A stabilizer structure for equipment having a lip, the stabilizer structure comprising:

an elongated main body portion comprising:

an upper portion configured to be coupled to a top surface of the lip, the upper portion comprising outward-facing side surfaces, a rearward top surface, and a forward top surface; and a forward portion configured to be coupled to a curved surface of the lip, the forward portion comprising:

a forward-facing curved surface; and a rear-facing curved surface, wherein a terminal end of the forward portion is sized to terminate adjacent a curved surface of the lip, wherein the rearward top surface of the upper portion and the forward top surface of the upper portion are both positioned between the forward portion and a rear end of the upper portion, and wherein the forward top surface is angled downward relative to the rearward top surface.

18. The stabilizer structure of claim 17, wherein the rear-facing curved surface includes a different curve than the forward-facing curved surface.

19. The stabilizer structure of claim 17, wherein the forward portion comprises an upper portion and a lower portion, and wherein a radial thickness of the upper portion is greater than a radial thickness of the lower portion.

20. The stabilizer structure of claim 17, further comprising a rear stabilizer portion, wherein the main body portion is configured to be positioned forward of an anchor hole in the lip, and wherein the rear stabilizer portion is configured to be positioned rearward of the anchor hole.

* * * * *